US010720019B2

(12) United States Patent
Hemovich et al.

(10) Patent No.: US 10,720,019 B2
(45) Date of Patent: Jul. 21, 2020

(54) GAMING SYSTEM HAVING CHANCE UPGRADING AND/OR OTHER TRANSFORM OF PLURAL SYMBOLS ALONG TARGET LINE

(71) Applicant: AGS LLC, Las Vegas, NV (US)

(72) Inventors: Marianne Louise Hemovich, Las Vegas, NV (US); Jeremy Michael Tuck, Lawrenceville, GA (US); Nathan Daniel MacGregor, Atlanta, GA (US); Eric Steven Boese, Decatur, GA (US); Alexander Bitterlin, Atlanta, GA (US)

(73) Assignee: AGS LLC, Las Vegas, NV (US)

( * ) Notice: Subject to any disclaimer, the term of this patent is extended or adjusted under 35 U.S.C. 154(b) by 243 days.

(21) Appl. No.: 15/867,298

(22) Filed: Jan. 10, 2018

(65) Prior Publication Data

US 2019/0213838 A1 Jul. 11, 2019

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/3216* (2013.01); *G07F 17/3244* (2013.01); *G07F 17/34* (2013.01)

(58) Field of Classification Search
CPC ..... G07F 17/3267; G07F 17/3213; G07F 17/3216; G07F 17/3244; G07F 17/34
See application file for complete search history.

(56) References Cited

U.S. PATENT DOCUMENTS

| | | | |
|---|---|---|---|
| 7,252,591 | B2 | 8/2007 | Van Asdale |
| 7,402,102 | B2 | 7/2008 | Marks et al. |
| 7,780,519 | B2 | 8/2010 | Gomez et al. |
| 8,272,938 | B2 | 9/2012 | Gilmore et al. |
| 8,328,621 | B2 | 12/2012 | Kim |
| 9,275,523 | B1 | 3/2016 | Hughes et al. |
| 2009/0137309 | A1 | 5/2009 | Thomas |
| 2010/0160045 | A1 | 6/2010 | Yamada et al. |

(Continued)

OTHER PUBLICATIONS

Office Action dated Mar. 9, 2017 in U.S. Appl. No. 14/096,251.

*Primary Examiner* — William H McCulloch, Jr.
*Assistant Examiner* — Ankit B Doshi
(74) *Attorney, Agent, or Firm* — Vierra Magen Marcus LLP

(57) ABSTRACT

Wager-based video slot reel games are disclosed where additional prizes or other gains can be awarded after completion of an initial gaming action based upon application of a multi-symbol transformation (MST) tool along a MST target line extending through a gaming action outcome display area. In one embodiment, the MST tool is a virtual razor blade capable of slicing open razor-susceptible initial symbols found along the MST target line where the cutting open action can unleash additional prizes, juices or entertaining effects hidden within the razor-susceptible initial symbols. The availability of the MST tool at the end of a current gaming action or for a next gaming action is signaled to the player in one embodiment to thereby heighten the expectations of the player of winning the additional prizes or other gains due to the multi-symbol transformation action of the available MST tool.

12 Claims, 15 Drawing Sheets

(56) References Cited

U.S. PATENT DOCUMENTS

| | | | | |
|---|---|---|---|---|
| 2010/0255902 | A1* | 10/2010 | Goldstein | G07F 17/32 463/29 |
| 2012/0172106 | A1 | 7/2012 | Caputo et al. | |
| 2015/0154834 | A1* | 6/2015 | Grace | G07F 17/3244 463/20 |
| 2018/0286181 | A1* | 10/2018 | Craig | G07F 17/3267 |
| 2019/0005770 | A1* | 1/2019 | MacGregor | G07F 17/3258 |
| 2019/0147691 | A1* | 5/2019 | Grace | G07F 17/3213 |

* cited by examiner

Symbol Transformation Results

5

GAMING SYSTEM HAVING CHANCE UPGRADING AND/OR OTHER TRANSFORM OF PLURAL SYMBOLS ALONG TARGET LINE

TECHNICAL FIELD

The present disclosure of invention relates to operations of a gaming machine within a gaming environment.

Slot-type electronic and/or mechanical gaming machines, often also referred as slot machines, are popular fixtures in casino or other gaming environments. Participants in gaming environments may include a primary player who is directly using the slot machine, an adjacent player who is directly using an adjacent slot machine, an adjacent bystander (e.g., a player's friend) who standing nearby the primary player or adjacent player and nearby passers by who happen to be passing by in an area where they can view part of the gaming action(s) of one or more of the slot machines. Slot machines may use mechanical reels or wheels and/or video reels or wheels to present both action during development of a game outcome and a finalized outcome of a slot game to a corresponding one or more players. Typically, before each gaming action by the machine (e.g., spinning of the reels or wheels), the player is required to ante up by placing at least one wager on the outcome of the gaming action. More specifically, the player may select or define a straight or other line that will operate as an actively-wagered upon payline along which, game-generated randomly distributed symbols are evaluated to determine if a winning combination is present (e.g., a sequence defining combination such Jack, Queen, King, Ace, etc. cards, hereafter also J, Q, K, A). If the actively-wagered upon payline provides a winning combination, the player is rewarded (e.g., monetarily and/or otherwise). Various outcome enhancing symbols such as wild symbols can appear on the reels or wheels of the game. Wild symbols typically serve as outcome enhancing substitutes for symbols needed to form a winning combination. In various prior art games, wild symbols: (1) can come into existence by other symbols individually morphing into wild symbols; (2) they can be individually copied from one reel or wheel to another; (3) they can be dropped from an animated character (e.g., cartoon) onto the reels or wheels to individually change certain existing symbols on a scatter distributed basis; and (4) they can populate a reel or wheel more frequently during so-called, free spins. In one particular published US application 2015-0154834 ("Electronic Gaming Device With Slash Functionality"), players are given an opportunity to individually slash open various grid cells covered by a slash-here indication for the possibility of winning one-at-a-time rewards from the user-driven individual slash operations. On occasions, a player may be awarded with a series of free spins where the player does not put a wager amount at risk and yet the player may, in some respect, win something for nothing during any one of the series of free spins. Due to such occasional sprinklings of chance of winning from free spins, from wild symbols, from individualized slash-here operations and/or due to various graphic and audio effects presented by the gaming action in general, the primary players and adjacent other persons may experience various emotional responses and derive entertainment value from the unique ways in which the game is played and game outcomes are developed and presented on the gaming machine.

In one example of the prior art (PowerXStream™ game), a random and individualized Wild substitution game is featured in a base game and free spins are also provided, thus maximizing a number of ways to win by evaluating awards based on a number of symbols present in any position rather than along a specific straight line, and providing a scatter-initiated bonus with bonus symbols that appear on all reels during the base game. The display includes a top screen that features progressive windows and shows a statue holding a coin. During the bonus game, the statue becomes animated, flips a coin into the air and awards a random number of bonus Wilds, which are scatter distributed to end up covering random symbol positions on the reels of a lower screen. These covered positions become the Wild symbols. However, this scatter distribution of Wild symbols does not inherently operate across a full line such as a full payline of symbols so as to by-chance transform and/or upgrade all the symbols along the full line. Accordingly, the player has no reasonable expectation that a full line (e.g., payline) of symbols will be transformed with at least some of the transformations resulting in symbol upgrades whereby an improved chance for increased winnings and/or other bonuses is provided due to the transformation of the full line. It may be desirable to increase the potential for derived entertainment value and/or experienced emotional responses and heightened expectations through modifications to one or more slot machine designs and/or through modifications to an overall gaming environment of which the players and their onlookers are a part by providing for potential (e.g., by-chance) upgrading and/or transformation of plural symbols along a full line such as an active payline. It is to be understood that some concepts and ideas provided in this description of the Technical Field may be novel rather than part of the prior art.

SUMMARY

Various embodiments in accordance with the present disclosure of invention generally relate to operating a gaming machine to generate one or more wager-based video slot games. Such wager-based video slot games can include ones where monetary or nonmonetary prizes, awards (e.g., symbol upgrades, additional free spins or bonus games) are awarded based for example upon the chance appearance of a special line-transformation symbol (for example within an initial spin outcome of a displayed gaming action or elsewhere). More specifically, and as an example, an initial spin outcome may be augmented by post-spin awarding of one or more wild symbols (e.g., wild cards) along a predetermined line where the locations of one or more of the bonus awarded wild symbols allows for substitution of the wild symbols with appropriate other symbols that result in a winning combination of displayed symbols in a primary outcome display area (e.g., four Aces in a row, four Kings, other symbol combinations in a row or otherwise scattered).

A possible awarding of just one bonus wild symbol in one spot in a game outcome grid can be seen as constituting an excitement-providing symbol upgrade. However, while an award of a single symbol upgrade adds excitement to the gaming action, greater excitement and/or expectation can result from the chance presentation of a multi-symbols transformation tool that can by-chance upgrade more than one symbol at a time, for example by transforming and possibly upgrading all the symbols of a given line in the game outcome display (e.g., upgrading all the symbols of a payline). In particular, in one embodiment, an along-the-line transforming tool (e.g., an along-the-payline gifts out-pouring tool such as a box cutter for opening a whole line of hidden gift containers) appears with the promise that it will be applied to all the symbols along a given line and unleash a whole series of upgrades or other awards. When applied, the tool can by-chance cause respective upgrades to all the displayed symbols of the given line or only to some of them or consequential upgrades to nearby other symbols. Expectation and excitement tend to be heightened when the multi-symbol transforming tool appears because the primary player (and optionally nearby bystanders) can foresee the possibility of an entire line of symbols (and optionally even more) being upgraded or otherwise transformed by the multi-symbol transforming tool so as to unleash a whole series of upgrades or other rewarding effects.

More specifically, in accordance with one aspect of the present disclosure, a machine-implemented method is provided comprising the steps of: (a) causing, in response to receiving indication of a player submitted wager, an actuation of a first gaming action corresponding to the submitted wager, the first gaming action completing with a display of a combination of initial symbols in a gaming action outcome area; (b) prior to full completion of the actuated first gaming action, causing a first determination as to whether an additional bonus opportunity will be presented to the player for possibly obtaining additional gains beyond first gains, if any, obtained on the basis of full completion of the first gaming action taken alone; (c) in response to said first determination determining that the additional bonus opportunity should be presented, causing presentation to the player of at least one multi-symbol transforming (MST) tool that can be applied to multiple ones of the initial symbols as found along a respective at least one MST target line; (d) following said presentation of the at least one MST tool, causing application of the at least one MST tool to the multiple initial symbols found along the respective at least one MST target line; (e) responsive to the application of the at least one MST tool, causing respective transformations of at least two of the multiple initial symbols found along the respective at least one MST target line, where the caused transformations can result in at least one of: upgrading of the respectively transformed initial symbol, production of a prize from the respectively transformed initial symbol, production from the respectively transformed initial symbol of a virtual projectile that can enhancingly further transform others of initial symbols not found along the respective at least one MST target line, and presentation of pleasing visual and/or audio effects; and (f) responsive to the transformations of at least two of the multiple initial symbols found along the respective at least one MST target line and responsive to the enhancing further transformation caused by the virtual projectile, if produced, tallying up the additional gains to be awarded to the player as a result of the application of the at least one MST tool.

Additionally, in accordance with one aspect of the present disclosure, a machine system is provided comprising: (a) a first machine component receiving indication of a player submitted wager and to responsively cause actuation of a first gaming action corresponding to the submitted wager, the first gaming action completing with a selection of a combination of initial symbols for display in a gaming action outcome area; (b) a second machine component, coupled to the first machine component to detect completion of the actuated first gaming action and, after completion of the actuated first gaming action but not necessarily after settlement of display of the initial symbols to the player, causing by-chance or other event triggered initiation of a post-completion bonus award opportunity wherein the post-completion bonus award opportunity includes an opportunity for multi-symbol transformation (MST) along a respective MST target line within the gaming action outcome display area of the actuated first gaming action, the post-completion bonus award opportunity allowing for possible obtaining of additional gains beyond first gains, if any, obtained on the basis of completion of the first gaming action taken alone; (c) a third machine component, coupled to the second machine component to detect initiation of the post-completion bonus award opportunity and configured to cause presentation of at least one MST tool that can be applied to plural initial symbols found along a respective MST target line to attempt to transform the initial symbols found along that respective MST target line; and (d) a fourth machine component, coupled to the third machine component and configured to determine if and which MST tool will be applied along which respective MST target line to attempt to transform the initial symbols found along that respective MST target line. In one embodiment, the machine system further comprises: (e) a fifth machine component coupled to the fourth machine component and configured to cause presentation of the determined MST tool being applied along the determined respective MST target line in an attempt to transform the initial symbols found along that determined respective MST target line. In one embodiment, the fourth machine component is further configured to cause presentation of an apparent second spinning of chance reels or wheels whose chance settlement outcome determines at least one of: (a) which MST tool will be applied and (b) which MST target line the applied MST tool will be applied along. In one embodiment, prior to display of the of the initial symbols to the player, the fourth machine component is configured to cause presentation to the player of a selection mechanism that allows the player to pick one of a plurality of different MST target lines. In one embodiment, prior to display of the of the initial symbols to the player, the fourth machine component is configured to cause presentation to the player of a selection mechanism that allows the player to pick one of a plurality of different MST tools. In one embodiment, the at least one multi-symbol transforming (MST) tool includes a virtual cutting tool for attempting to cut open the initial completion symbols of the first gaming action, where if the attempted cutting open is successful, it release at least one of prizes, projectiles and/or pleasing effects hidden within the initial completion symbols before they are cut open.

BRIEF DESCRIPTION OF THE DRAWINGS

The present disclosure may be better understood by reference to the following detailed description taken in conjunction with the accompanying drawings, which illustrate particular embodiments in accordance with the present disclosure of invention.

DETAILED DESCRIPTION

Reference will now be made in detail to some specific embodiments in accordance with the present disclosure of invention. While the present disclosure is described in conjunction with these specific embodiments, it will be understood that it is not intended to limit the teachings of the present disclosure to the described embodiments. On the contrary, it is intended to cover alternatives, modifications, and equivalents as may be included within the spirit and scope of the teachings of the present disclosure.

In the following description, numerous specific details are set forth in order to provide a thorough understanding of the present disclosure. Particular embodiments may be implemented without some or all of these specific details. In other instances, well known process operations have not been described in detail in order not to unnecessarily obscure the present disclosure of invention.

In general, gaming systems which provide wager-based games are described. In particular, with respect to FIGS. 1A, 1B and 2, a gaming system including a plurality of wager-based gaming machines in communication with network devices is described. The gaming system can include wager-based games where a progressively growing prize or award is made possible and/or where the unleashing of a whole series of bonuses or other awards is made possible.

Figure 1A:
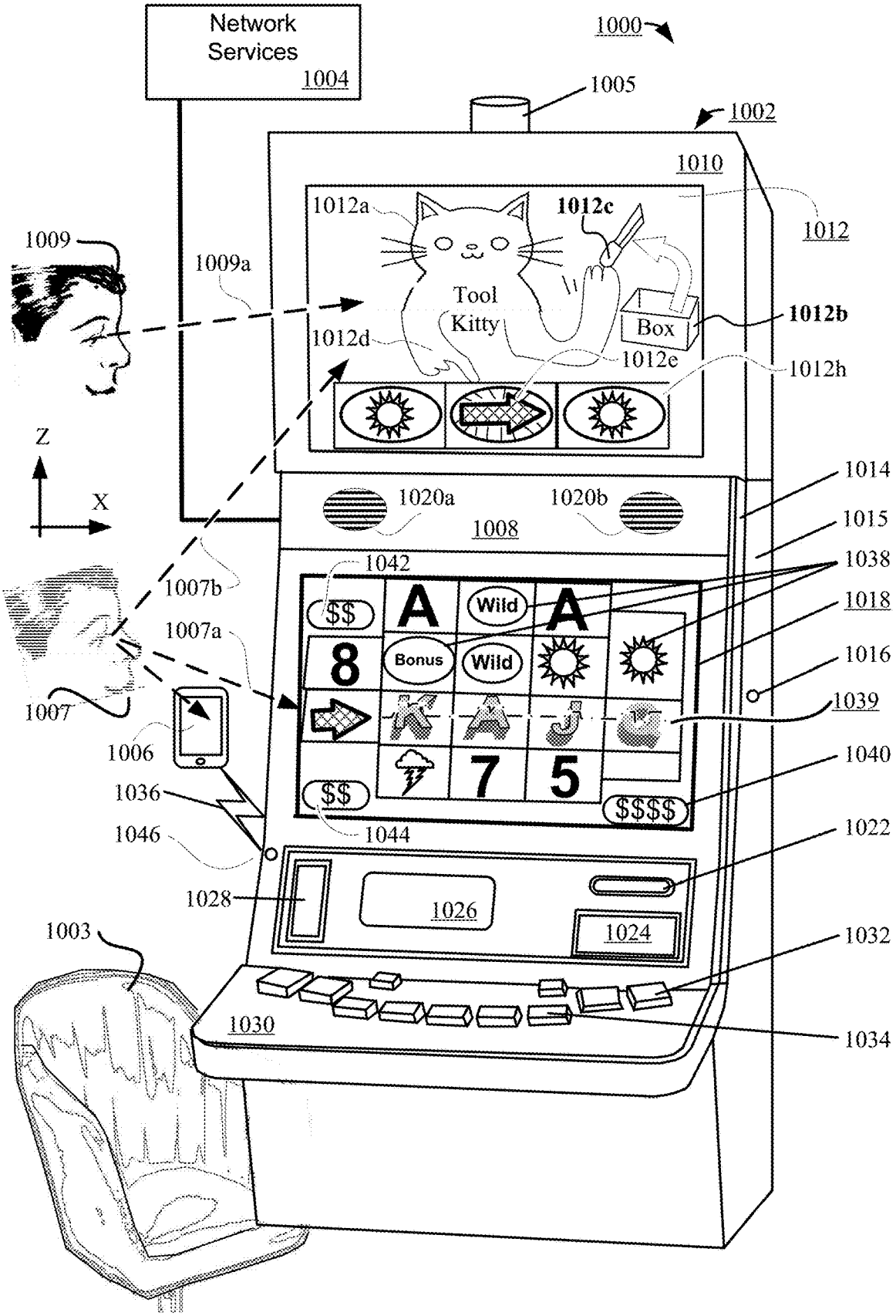
FIG. 1A illustrates a gaming system and environment including a wager-based gaming machine in accordance with the present disclosure.

FIG. 1A illustrates part of a gaming system 1000 in accordance with the disclosure that includes a wager-based gaming machine 1002. The wager-based gaming machine 1002 can include wireless or wired communication interfaces which allow communications with remote servers and/or other devices including a remote services providing network 1004 (e.g., having service providing servers and/or other data storing and processing units). The services providing network 1004 can provide privacy/integrity-secured services such as but not limited to player tracking and progressive gaming. (Some specific network services are described in more detail in conjunction with FIG. 2). The player tracking service can be part of a slot accounting system that for example keeps track of each players winnings and expenditures. In addition, the gaming machine 1002 can include wireless communication interfaces, such as a wireless interface 1046 (internal, not specifically shown) which allow communication with one or more mobile devices, such as a mobile phone 1006 (only one shown), a tablet computer, a laptop computer and so on via respective wireless connections such as 1036. The wireless interface 1046 can employ various electronic, optical or other electromagnetic wireless and secured or non-secured communication protocols, including for example Bluetooth™ or Wi-Fi.

The respective mobile phones (e.g., 1006) and/or tablet computers and/or other mobile devices can be owned and/or utilized by various players, potential customers or authorized casino operators. A mobile device carried by a primary player (e.g., 1007) can be configured to perform gaming related functions, such as functions associated with transferring funds to or from the specific gaming machine 1002 and the primary player's account(s) or functions related to player tracking. A mobile device carried by a casino operator can be configured to perform operator related functions, such as performing hand pays, responding to tilt conditions or collecting metering related information.

Use of mobile devices is not limited to secured transactions. In one embodiment, mobile devices may be used for social networking. For example, a primary player 1007 may authorize his/her mobile device (e.g., 1006) to automatically interact with a currently used gaming machine 1002 for the purpose of automatically posting to a user-chosen social network various announcements such as, but not limited to, that the primary player 1007 has been having fun playing the Tool Kitty Line Bonus Awarding game (a fictitious name for purposes herein) for X hours at the given gaming establishment or that the Tool Kitty Line Bonus Awarding game has just awarded the primary player 1007 a full line's worth of upgrades and/or other awards. The primary player 1007 may alternatively or additionally authorize his/her mobile device (e.g., 1006) to automatically announce (wirelessly) to a selected group of friends or associates that player 1007 has just been awarded a full line's worth of upgrades and/or other awards at gaming machine 1002 and inviting them to stop by and watch the fun (e.g., as nearby other person 1009 is doing over the shoulder of the primary player 1007, where the latter in one embodiment, is seated in chair 1003 situated in front of gaming machine 1002.)

According to the same or an alternate embodiment, the primary player 1007 may use his/her mobile device (e.g., 1006) to temporarily reserve the particular gaming machine 1002 for a predetermined amount of time (e.g., no more than say 10 to 30 minutes) so that the primary player may temporarily step away to attend to various needs. While the primary player 1007 is temporarily away, the gaming machine 1002 may display a reservation notice saying for example, "This machine is reserved for the next MINI minutes by a winning player who was recently awarded a full line's worth of bonus upgrades and/or other awards. Stand by and watch for more such winnings!" (where here MINI is a progressively decreasing time counter). The reservation notice may be prominently posted on an upper display 1012 of the gaming machine 1002 as shall next be described.

The gaming machine 1002 can include a base cabinet 1008 and an upper or top box 1010 fixedly mounted above the cabinet. The top box 1010 includes an upper display 1012. The upper display 1012 can be used to display video content, such as game art associated with the game being currently played on the gaming machine 1002. For example, the game art can include one or more animated wheels or reels (or other chance indicating mechanisms) and/or one or more animated creatures (e.g., the tool selecting and wielding Tool Kitty illustrated at 1012*a*). The animated wheels or reels (e.g., horizontally scrolling reel 1012*h*) can be configured to spin and to stop to reveal an occasional activation of a multi-symbol transforming tool (e.g., a line transforming tool such as a razor blade 1012*c* whose appearance or activation is triggered in response to appearance of a special multi-symbol transformation announcement symbol 1012*e* at a predetermined stoppage position or area). In one embodiment, the predetermined stoppage position or area may be pointed to by an animated finger 1012*d* of the tool wielding Tool Kitty character 1012*a*. In one embodiment, a free other hand of the character may wave or otherwise gesture to attract attention to the current selection and upcoming use of the line transformation tool 1012*c* (a line slicing razor blade in this example) which, in one embodiment, is by-chance pulled out from a tool box 1012*b* containing a plurality of different kinds of line transformation tools (not shown, but could for example include a line-spraying water hose, a line-burning flame thrower, a line-slicing buzz saw, etc.). At other times and/or in other examples, the video content of the upper display 1012 can include advertisements and promotions. In accordance with an aspect of the present disclosure, a line-transforming tool (e.g., razor 1012*c*) that is used during a first line transformation operation is inhibited from appearing for a next subsequent second line transformation operation and instead a different tool is used whereby different rather than repeatedly same line transformation effects are presented to the player (and bystanders) so as to create expectation of new, interesting and attention grabbing effects each time. In one embodiment, the tool wielding Tool Kitty character 1012*a* (or another animated character) draws attention to the fact that a different tool will more probably than not be pulled out of the tool box by-chance or on a round robin basis in a next go round.

In alternate embodiments, the top box 1010 can include one or more mechanical and/or electronic devices in addition to the upper video display 1012. For example, mechanical devices, such as one or more mechanical wheels can be mounted to or within the top box 1010. The mechanical wheel(s) can include markings that indicate various bonus award situations and/or situations where line-transforming tools will be used. The wheel(s) can be spun and stopped at particular stopping points to reveal a bonus award situation or a multi-symbol transformation situation (e.g., 1012*e*). In yet other embodiments, the top box 1010 can include a plurality of upper displays that provide similar functions. With respect to chance providing mechanisms as described herein, it is to be understood that such can include not only mechanical chance providing mechanisms (e.g., mechanical spinning wheel with relatively unpredictable stop position), but also electronically based chance providing mechanisms that can be implemented in the form of digital and/or analog electronic circuits. Such circuits may rely on flip-flops or registers designed with intentional meta-stability and/or on noise intolerant switching circuits that are intentionally exposed to random noise (e.g., thermal noise) so as to provide relatively random and unpredictable outcomes.

It will be appreciated by those familiar with gaming environments that participants in various gaming environments (also briefly see FIG. 2) include respective primary players like 1007 who are directly using their respective slot machines (e.g., 1002) and are each typically seated on a chair (e.g., 1003) disposed in front of the gaming machine so as to thereby position that primary player's eyes substantially level with a central vertical position (along the vertical Z axis) with a primary game outcome display area 1018 of the gaming machine 1002 thus allowing for a comfortable gaze angle indicated by viewing vector 1007*a*. The primary game outcome display area 1018 typically being positioned vertically below and slightly spaced apart from the upper video display area 1012. The vertical elevation of the upper video display area 1012 is chosen so as to be easily viewed by adjacent player(s) who is/are directly using adjacent slot machines (for example at an eye incline angle shown as viewing vector 1007*b*) and also to be easily viewed by adjacent bystanders 1009 (e.g., a player's friends) who are standing nearby the primary player or nearby one of the adjacent players or are nearby passers by who happen to be passing by in an area where they can view part of the gaming action(s) of one or more of the slot machines; and in particular the actions displayed by the upper video display 1012 at a comfortable viewing vector 1009*a*. Due to real or simulated movements of the mechanical reels and/or video reels in the primary game outcome display area 1018 and in the upper video display area 1012, the primary players and the adjacent other persons may experience various emotional responses and derive entertainment value and expectations for further excitement from the unique ways in which the slot game (e.g., the Tool Kitty Line Bonus Awarding game illustrated as an example in areas 1012 and 1018, where the line cut is performed along full line 1039) is played and presented on the gaming machine. In accordance with one aspect of the present disclosure, when a line-transforming tool (e.g., razor 1012*c*) is applied to an identified line (e.g., active payline 1039), all the symbols initially displayed as game outcomes along that line may be upgraded and/or otherwise transformed so as to provide the player with yet additional gains (monetary or otherwise) aside from the gains provided by the initially displayed symbols (e.g., King, Ace, Jack and Queen in the case of exemplary and to-be-transformed line 1039). On the other hand, it is not necessary that all the symbols along the target line (e.g., 1039) be transformed by a specific line-transforming tool (e.g., 1012*c*). In some instances, one or more of the initially displayed symbols (e.g., K, A, J, Q) may be assigned a texture and/or other character denoting attribute that indicates the given symbol is immune to the specific line-transforming tool. Thus, the line-transform attempting operation that ensues as the line-transforming tool (e.g., 1012*c*) is picked and applied to the target line (e.g., 1039) may vary as a function of not only the selection of the specific line-transforming tool (e.g., it could instead be a water hose, flame thrower, boxing glove, etc.) but also as a function of certain attributes assigned by-chance to initially displayed symbols (e.g., K, A, J, Q) of the targeted line (e.g., 1039). Accordingly, while players are given an expectation that all of the initially displayed symbols (e.g., K, A, J, Q) of the targeted line have a fair chance of being upgraded or otherwise transformed to yield additional gains, the players may at the same time be given a foreboding that some of the initially displayed symbols (e.g., K, A, J, Q) of the targeted line (e.g., 1039) will by-chance be immune to the selected tool and will not be transformed. A mixture of emotions may therefore be created of both heightened expectations and foreboding that all the expected rewards may or may not be realized. If the primary player 1007 continues to win across entire lines, the expectation of bigger payout increases, thus providing increased entertainment and excitement to those nearby the gaming machine 1002 (and optionally to those on social media who are following the primary player's progress).

In terms of details for one embodiment, the base cabinet 1008 includes an internal access entry mechanism instantiated for example as door 1014. The door 1014 swings outward and is coupled to a back portion 1015. The door 1014 includes a locking mechanism 1016. During normal operation, the door 1014 is locked. Typically, unlocking the door 1016 causes the gaming machine 1002 to enter a tilt mode where gaming functions, such as the play of a wager-based game, are not available. This tilt mode can be referred to as a hard tilt.

The cabinet 1008 can include a number of apertures that allow access to portions of a number of devices which are mounted within the cabinet. These gaming devices can include, but are not limited to displays such as 1018 and 1026, speakers such as 1020*a* and 1020*b*, a printer 1022, a bill acceptor 1024, a magnetic and/or chipped card reader 1028 and a resting shelf and/or button panel 1030 including buttons 1032 and 1034. As described in more detail below, these gaming devices can be used to generate wager-based game play on the gaming machine 1002.

In particular embodiments, the bill acceptor 1024 can be used to accept currency or a printed ticket which can be used to deposit credits into an account maintained for the primary player 1007 and/or the gaming machine 1002. The credits can be used for wagers. The printer 1022 can be used to print tickets to transfer credits from one gaming machine (e.g., 1002) to another or to monetize accumulated credits. Typically, the tickets can be redeemed for cash or additional game play, such as game play on another gaming machine or at a gaming table.

Figure 2:
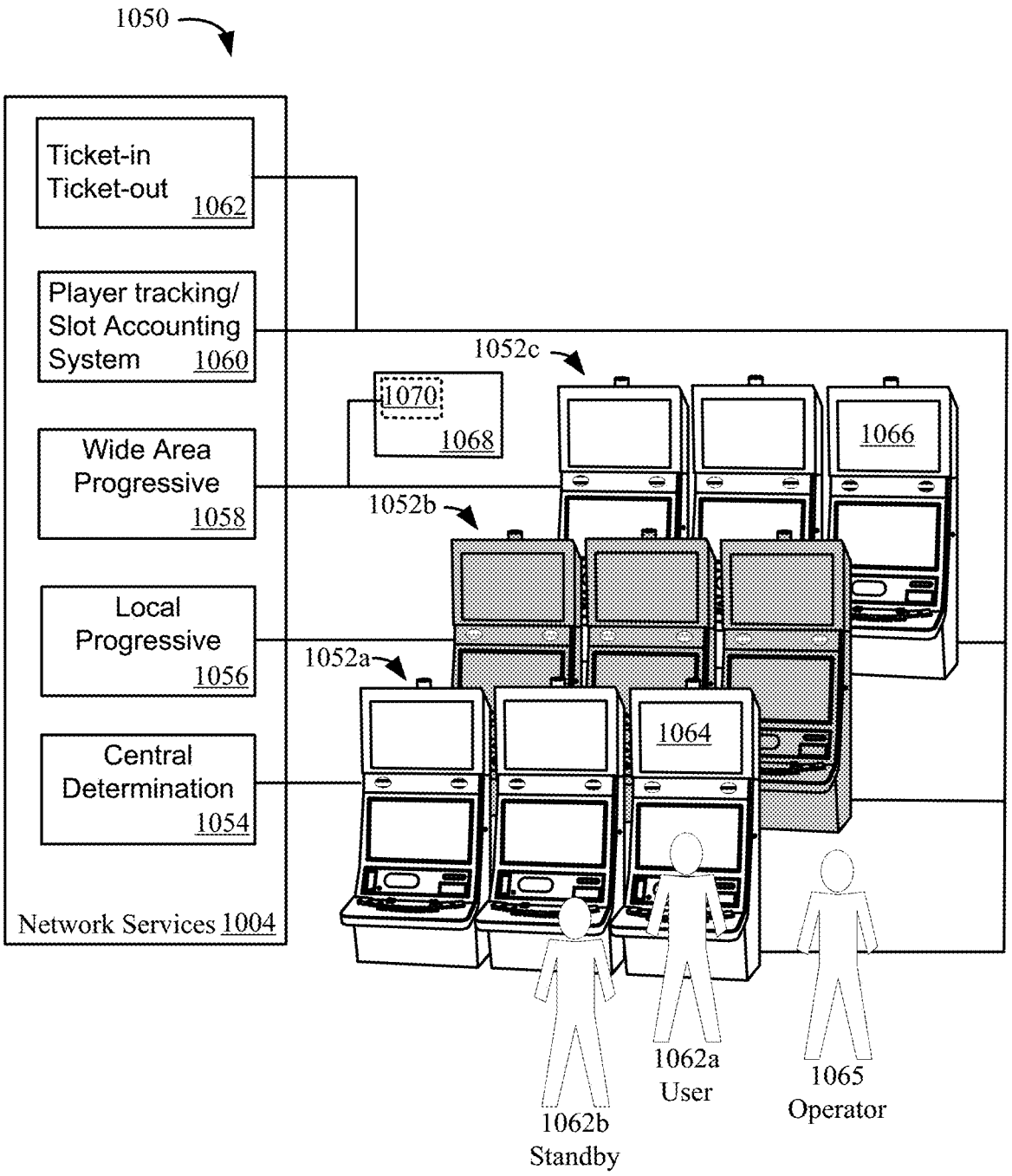
FIG. 2 illustrates a gaming system including three banks of gaming machines in accordance with the present disclosure.

The bill acceptor 1024 and printer 1022 printer can be part of ticket-in/ticket-out (TITO) system 1062 illustrated in FIG. 2. The TITO system 1062 can be included as one of the secured services provided by the services network 1004. The TITO system allows a ticket printed at a first gaming machine with a credit amount to be inserted into a bill acceptor at a second gaming machine and validated for game play. After validation, the credit amount associated with the ticket can be made available for game play on the second gaming machine. Additional details of the TITO system 1062 are described below in conjunction with FIG. 2.

The bill acceptor 1024 can include a slot surrounded by a bezel which allows banknotes of various denominations or printed tickets to be inserted into the bill acceptor. The bill acceptor 1024 can include sensors for reading information from the banknotes and determining whether the banknotes inserted through the slot are valid. Banknotes determined to be invalid, such as damaged or counterfeit notes, can be automatically ejected from the bill acceptor 1024. In some instances, the bill acceptor 1024 can include upgradeable firmware and a connection to additional network services. Via the network connection, new firmware, such as new counterfeit detection algorithms can be downloaded to the bill acceptor 1024.

The bill acceptor 1024 includes mechanisms for guiding the banknotes or printed tickets past the internal sensors. Banknotes or printed tickets which are accepted can be guided to a bill stacker (not shown) located within the cabinet 1008 of the gaming machine 1002. The bill stacker can hold a maximum number of bank notes or printed tickets, such as up to two thousand.

The gaming machine 1002 can include a sensor for detecting a fill level of the bill stacker. When the bill stacker is full or close to being full, the gaming machine 1002 can be placed in a tilt mode. Next, the cabinet door 1014 can be opened by authorized casino personnel and the full bill stacker can be replaced with an empty one. Then, the door 1014 can be closed and the gaming machine 1002 can be restored to a normal operational mode in which it is available for game play.

One function of the printer 1022 is to print "cash out" tickets. In a "cash out," credits available on the gaming machine can be transferred to an instrument, such as a printed and/or magnetically encoded ticket, or wirelessly transferred by way of a secure link to an appropriate account (e.g., the primary player's account) for later access. Typically, a "cash out" can be initiated in response to pressing one of the physical buttons, such as 1032 or 1034, or touch screen button output on a display, such as primary display 1018 or a secondary display such as the one 1026 illustrated to be smaller than and disposed below the primary game outcome display 1018.

In one embodiment, the printer 1022 can be a thermal printer. The printer can be loaded with a stack of tickets, such as a stack with two hundred, three hundred or four hundred tickets. Mechanisms in the printer can grab tickets from the ticket stack and transport the tickets past the print heads for printing. The ticket stack can be located in an interior of the gaming machine cabinet 1008.

The printer 1022 can include sensors for detecting paper jams and a status of the ticket stack. When a paper jam or low ticket stack is detected, the gaming machine 1002 can enter a tilt mode where game play is suspended. In one embodiment, a tower light 1005 disposed above the upper box 1010 can light to indicate the tilt status of the gaming machine 1002. After the tilt condition is cleared, such as by clearing the paper jam or replenishing the ticket stack, the gaming machine 1002 can enter a normal operational mode where game play is again available.

In particular embodiments, the printer 1022 can be coupled to a gaming machine controller (see 1160 in FIG. 2). The gaming machine controller 1160 can be configured to send commands to the printer which cause a "cash out," ticket to be generated. In addition, the printer 1022 can be coupled to other systems, such as a player tracking system (e.g., 1060 in FIG. 2). When coupled to the player tracking system, commands can be sent to the printer 1022 to output printed tickets redeemable for comps (comps refer to complimentary awards, such as but not limited to free credits, a free drink, a free meal or a free room) or printed coupons redeemable for discounts on goods and services.

As mentioned, in some embodiments, one or more wireless interfaces 1046 can be provided to operate as secured and/or unsecured wireless communication connections 1036. The wireless connections can be established for example between the gaming machine 1002 and one or more mobile devices, such as smart phone 1006. The wireless connection 1036 can be used to provide functions, such as but not limited to player tracking services, casino services (e.g., ordering drinks) and enhanced gaming features (e.g., displaying game play information on the mobile device). The wireless interface can be provided as a stand-alone unit or can be integrated into one of the devices, such as the bill/ticket acceptor 1022 and the card reader 1028. In addition, the bill/ticket acceptor 1022 and the card reader 1028 can each have separate wireless interfaces for interacting with the mobile device. In one embodiment, these wireless interfaces can be used with a wireless payment system, such as Apple Pay™ or Google Pay™. The wireless payment system can be used to transfer funds to the gaming machine that can be used for wager-based game play.

The door 1014 can allow secured entry access an interior of the cabinet 1008. Via this access, devices mounted within the cabinet, such as displays 1018, 1026; speakers 1020*a*, 1020*b*; bill/ticket acceptor 1022 or printer 1024 can be serviced and maintained. For example, a receptor configured to receive currency and tickets, coupled to the bill acceptor, can be emptied. The receptor is often referred to as a bill stacker. In another example, blank tickets can be added to the printer 1022 or paper jams can be cleared from the printer. When door 1014 is opened, the gaming machine can enter a hard tilt state where game play is disabled. Although not explicitly shown, the audiovisual input/output mechanisms of the gaming machine 1002 need not be limited to the illustrated displays 1018, 1026; speakers 1020*a*, 1020*b* and buttons 1032, 1034. Additional audiovisual input/output mechanisms may come in the form of touch-sensitive screens, haptic input/output devices such as vibrators, subwoofers, microphones for picking up verbal requests or audible indications of excitement by the primary player or adjacent other persons and so on. In one embodiment, the chair 1003 may be instrumented so as to detect not only when the primary player 1007 is seated on it, but also when that player is jumping up and down or otherwise moving in the chair due to heightened emotions. This detected movement can be fedback to the services network 1004 for adaptively learning what gaming combinations tend to provide more excitement and/or entertainment. With authorization by the primary player 1007, a microphone and/or motion detector on his/her mobile device 1006 may be activated to provide similar automated feedback.

In addition, a number of further devices (not shown) can be provided within the interior of the cabinet 1008. A portion of these devices is not visible through an aperture in the gaming machine cabinet 1008. For example, a gaming machine controller (GMC) which controls play of a wager-based game on the gaming machine can be found within the cabinet 1008. Typically, the gaming machine controller is secured within a separate lockable enclosure. Details of the gaming machine controller are described below with respect to element 1160 in FIG. 8.

As another example, a number of security sensors can be placed within the interior of the cabinet 1008. The security sensors (e.g., see 1140 in FIG. 8) can be configured to detect access to the interior of the gaming machine 1002. For example, the sensors can be configured to detect when the locking mechanism 1016 is actuated, the door 1016 is opened or a locking mechanism associated with the gaming machine controller enclosure is actuated. A power source, separate from an external power supply, such as a battery can be provided which allows the security sensors to operate and be monitored when the external power supply is not connected or stops functioning for other reasons.

In particular embodiments, the cabinet 1008 can have a sheet metal exterior designed to provide the rigidity needed to support top boxes, such as 1010 and light kits as well as to provide a serious deterrent to forced entry. For example, the sheet metal can be sixteen gauge steel sheet. Additionally, the door, such as 1014, can be backed with sheet steel in the areas around the displays. Other materials, such as wood, wood composites, can be incorporated into the cabinet and the example of sheet metal is provided for the purposes of illustration only.

Speakers, such as 1020*a* and 1020*b* (only two shown, but there can be more elsewhere disposed), can be protected by a metal screen. In one embodiment, a speaker, such as 1020*a* or 1020*b*, can include a subwoofer speaker portion. In general, a sound system associated with the gaming machine 1002 can include an audio amplifier and one or more speakers of various types, such as subwoofers, midrange speakers, tweeters and two-way speakers that also accept voice input.

If the main cabinet 1008 is entered, a "DOOR OPEN TILT" can be displayed halting game play and causing a "DOOR OPEN" event to be sent to the slot accounting system in 1004. In one embodiment, this message can be displayed on the main display 1018. These events can also be stored to the power hit tolerant memory. Upon door closure, the "DOOR OPEN TILT" will be replaced with a "DOOR CLOSED TILT" that can clear after the completion of the next game cycle. Additionally, a logic "DOOR OPEN TILT" can occur if the logic door is opened. The logic door is configured to be lockable independent of how the switch wiring is installed. The gaming machine 1002 can be configured to initiate the logic DOOR "OPEN TILT" regardless of whether or not a lock is installed on the logic door.

The displays such as 1018, 1012 and 1026, the speakers 1020, the printer 1022, the bill acceptor 1024, the card reader 1028 and the button panel 1030 can be used to generate a play of a wager-based game on the gaming machine 1008. Further, the primary display 1018 can include a touchscreen function. The touchscreen function can be used to provide inputs used to play the wager-based game. Some examples of wager-based games that can be played include but are not limited to slot games, card games, bingo games and lottery games. The wager-based games are typically games of chance and utilize a random number generator to determine an outcome to the game.

In general, the wager-based games can be classified as Class II and Class III games. Class II games can include bingo, pull tabs, lottery, punch board, tip jars, instant bingo and other bingo like games. Class III games can include but are not limited to slot games, black jack, craps, poker and roulette.

As described above, the wager-based game can be a slot game. The play of the slot game can involve receiving a wager amount and initiating a start of the wager-based game. A selection of a wager amount and a start of the wager-based game can be performed using buttons, such as 1032 and 1034, on button panel 1030. In addition, the button panel can be used to perform gaming functions, such as selecting a number of lines to play in a slot game, selecting the amount to wager per line, initiating a cash-out and calling an attendant. These functions will vary for different types of games.

In some embodiments, a touch screen function can be provided in or adjacent to (e.g., over) one or more of the displays, such as 1012, 1018 and/or 1026. The combination of the display and touch screen can be used to perform gaming functions that performed using the button panel 1030. Also, display and touch screen can be used to perform operator features, such as providing a game playback or a hand pay.

The play of wager-based game, such as a slot game, can involve making a wager and then generating and outputting a game presentation. The bet amount can be indicated in display area 1042. The game presentation can include a number of game features that vary from game to game. The game features provide variety in how the outcome to the wager-based is presented. For example, an award to the outcome of the game can be presented in a series of steps that vary from game to game. In some instances, a portion of the total award for a game can be awarded in each step. The steps and their graphical presentation can be referred to as game features. In various embodiments, information associated with one or more of the steps can be stored to a power hit tolerant memory. The power hit tolerant memory is discussed in more detail with respect to FIG. 2.

As an example, a portion of a slot game outcome presentation is shown on display 1018. The slot game outcome presentation can include displaying a plurality of normal reel symbols, such as pointed to by reference 1038 (e.g., blazing sun symbol, wild card symbol, bonus symbol etc.). During the game outcome presentation, the symbols can appear to move on the display 1018 (e.g., vertically to simulate a rotating reel). In addition, symbols can be made to appear to move off the display 1018 and new symbols can be made to newly appear onto the display 1018.

Different combinations of symbols can appear on the primary display 1018 for some period of time, which varies for each instance of the wager-based game that is played. At the end of an action-filled presentation, the symbols can be made to appear to settle and reach a final position or spin outcome. Then an award associated with the game outcome is presented on the display. The total award for the game can be indicated in display area 1044 for example and the total credits available on the gaming machine after the award can be indicated in display area 1040.

In particular embodiments, a portion of the award to the outcome of a game or spin can be presented as a bonus game or a bonus spin (e.g., a free spin). The portion of the award can be referred to a bonus award. The presentation of the bonus award can also be presented in steps where a portion of the bonus award is awarded in each step. These steps can be referred to as bonus game features. In some embodiments, information associated with the steps in the bonus game can be stored to the power hit tolerant memory. In various embodiments, components of the bonus game presentation can be presented on one or more of display 1018, 1012 and 1026.

More specifically in one embodiment, when a given spin takes place (e.g., indicated as such in one of display areas 1018, 1012 and 1026), a by-chance bonus awarding horizontal reel 1012*h* is also actuated and starts spinning. As the symbols in the primary display area 1018 start settling into a near-final outcome state, the horizontal bonus reel 1012*h* first settles into its final outcome state, where that latter state can include the presentation of a special bonus situation symbol 1012*e* (e.g., indicating that a multi-symbol transforming tool; e.g., a line-transforming tool is soon to be applied). The special bonus situation symbol 1012*e* can appear in one or more predetermined regions (e.g., on horizontal reel 1012*h* and/or along line 1039 of main game outcome display area 1018). In the illustrated example, the same special bonus situation indicating symbol (same as 1012*e*) appears at the left side of a game-selected target line (e.g., 1039) being eyed 1007*a* by the primary player 1007 to indicate to that player that this horizontal line is the line along which a to-be-selected or already selected line-transforming tool will be applied. In one embodiment, the line-transforming tool is not yet selected at the time the game-selected target line (e.g., 1039) is identified to or by the player. In one embodiment, the game-selected target line (e.g., 1039) is one of the currently active, wagered-upon paylines of the current gaming action. In an alternate embodiment (not explicitly shown), the game-selected target line can be drawn at an inclined angle to cut across symbols of plural parallel paylines of the current gaming action where it is understood that the attempted transformation action of the line-transforming tool (optionally not-yet-selected) will be applied to all the symbols intersected by that inclined line. In one embodiment, the attempted transformation action will transform (e.g., upgrade) at least two of the multiple symbols initially found along a respective target line. In another alternate embodiment (not explicitly shown), the game-selected target line can be drawn as a non-linear zig zagging line, curved line or the like to intersect with a plurality of symbols that settling into an initial game outcome state in the main game outcome display area 1018 where it is understood that the transformation action of the line-transforming tool (optionally not-yet-selected) will be applied to all the symbols intersected by that nonlinear line. Once the line-targeted symbols (e.g., those targeted by displayed line 1039 or by another symbols targeting line) are indicated to the player (1007), that player can have heightened expectation that a whole series of gains are about to be potentially awarded to the player if an appropriate line-transforming tool (optionally not-yet-selected) is provided for effectively upgrading or otherwise transforming all the line-intersected symbols (and optionally even more nearby symbols as will be detailed below).

In one embodiment, however, as the line-targeted symbols are indicated to the player (1007), the line-targeted symbols take on respective textures or other attributes (e.g., metallic luster, wooden texture, glassy texture, translucent ice texture, food item texture, spongy or rubbery texture, etc.) that indicate how they might respond to the respective attempted transformation actions of different respective ones of line-transforming tools (optionally not-yet-selected) that will next be applied to all the symbols intersected by that symbols targeting line (e.g., 1039). More specifically, and merely as an example; if the by-chance selected line-transforming tool is the razor blade (illustrated at 1012*c*) and one of the line-targeted symbols is presented with a metallic luster (thus indicating it is made of a razor resistant metal), the tool may fail transform that metallic luster symbol when run across the symbol. By contrast, if one of the line-targeted symbols is presented or associated with a food-like texture (say pineapple), the razor blade (1012*c*) will easily cut through that line-targeted symbol and release a projectile such as gusher of fruit juice (e.g., pineapple juice) that is associated with a predetermined type of gain for the player. In one embodiment, at least two of the plural symbols initially found along the respective MST target line (e.g., 1039) will be transformed. More specifically for example, if a virtual juice (or other emitted projectile) is produced as part of the transformation (e.g., razor slicing) of the initial symbols, the juice may be animated as flowing into the credits counter 1044 and increasing the credits currently available for the player. Alternatively or additionally, the released virtual fruit juice might drip into a lower down symbol and upgrade that dripped on symbol into being an extra WILD symbol. If plural ones of the line-targeted symbols are indicated as juice producing ones, then the juice releases from those plural line-targeted symbols may accumulate into a large stream that flows into the credits counter 1044 and greatly increases the credits currently available for the player and/or the juice drops may spill onto plural ones of lower down symbols and convert those dripped on symbols into being an extra WILD symbols or otherwise upgraded symbols. In one embodiment, gain providing projectiles (e.g., fluids such as juices) may squirt up in addition to or in place of dripping down to thereby transform symbols above the line-targeted symbols. In one embodiment, the released virtual juice is effective only on nearby symbols that are parts of active (wagered-upon) paylines. This constraint encourages players to wager on more than one payline at a time in hopes that upgrading juice will drip on symbols of the more than one payline if a juice (or other projectile) expelling operation is applied to one or more symbols of a nearby other line. In one embodiment, the Tool Kitty character 1012*a* repeatedly reminders players about this feature.

Figure 1B:
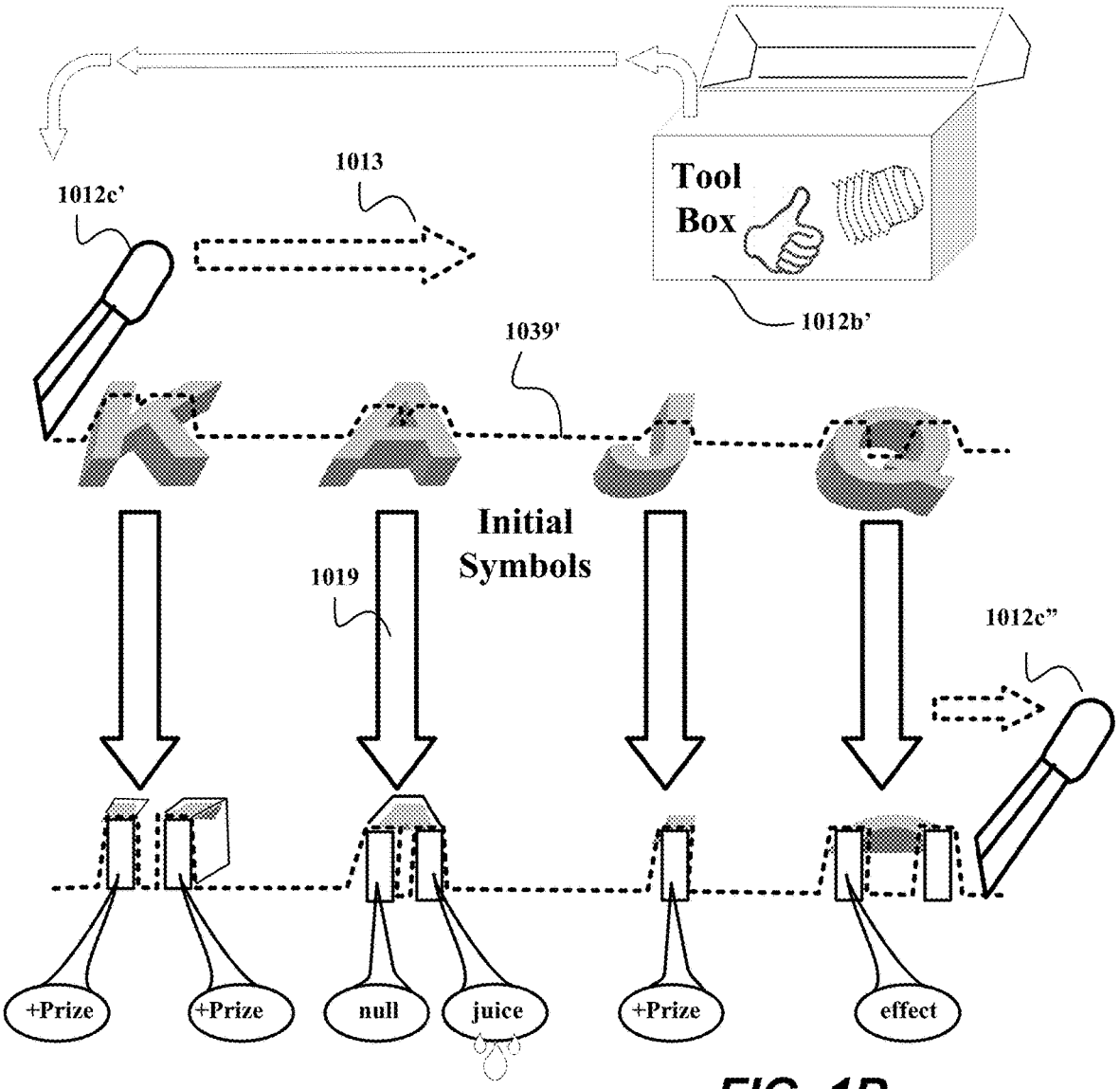
FIG. 1B illustrates a possible awards unleashing action when a line cutting tool (e.g., razor blade) is selected by-chance as a multi-symbol transforming (MST) tool from a tool box populated by a variety of along-a-line transforming tools.

Referring to FIG. 1B, a machine-implemented example process in accordance with the present disclosure is described in more detail. A symbols targeting line 1039' is drawn or otherwise indicated for a series of symbols (e.g., K, A, J, Q) that either are already settled in the main outcome display area 1018 or are shortly to settle along that targeting line 1039'. Next a multi-symbol transforming tool (e.g., a line-transforming tool such as razor blade 1012*c*') is picked by-chance or on a round-robin basis from a displayed virtual tool box 1012*b*' and brought into contact with one end of the symbols targeting line 1039'. This actuation of the transforming tool may occur even before settlement occurs with respect to what the initial (pre-transformation) series of symbols (e.g., K, A, J, Q) will be along the targeting line; or it may occur after the initial series of symbols (e.g., K, A, J, Q) have settled along that symbols targeting line 1039'. In one embodiment, the settled initial series of symbols (e.g., K, A, J, Q) arrive as or morph into three-dimensional (3D) raised symbols respectively having one or more respective, attribute designating skins (e.g., textures). Because the player may not initially know which tool 1012*c*' will be picked and/or what transformation attributes will be assigned to the settled initial series of symbols (e.g., K, A, J, Q), a sense of excitement and anticipation may be imparted to the player as these questions get resolved one after another. More specifically and in one embodiment, if all the settled initial series of symbols (e.g., K, A, J, Q) inherit fruit-like skins (or are associated with such fruits because the latter appear adjacent to the symbols) then the player may come to expect that the razor blade tool 1012*c*' will be able to easily cut through all the fruit-like symbols along line 1039' and that gain providing juices' will squirt out of those razor cut series of symbols (e.g., K, A, J, Q).

It is to be understood that such an along-the-line transformation of the settled initial series of symbols (e.g., K, A, J, Q) does not detract from any winnings obtainable from the settled initial series of symbols. Thus if the settled initial series of symbols (e.g., K, A, J, Q in the illustrated example) on their own provide positive gaming action results (e.g., payment based on the player-made wager), any gains from the along-the-line transformation action by the selected tool will be in addition to the winnings obtained based on the settled initial series of symbols.

In one embodiment, the player is given the option of picking the along-the-line transformation tool (e.g., razor, water hose, flame thrower, buzz saw) before the initial series of symbols (e.g., K, A, J, Q) have settled along a respective symbols targeting line 1039'. In one embodiment, the player is given the option of selecting or drawing a targeting line before the initial series of symbols (e.g., K, A, J, Q) have settled into position for thereby defining an initial (pre-transformation) game outcome. In alternate embodiments, the gaming machine automatically picks the multi-symbol transforming tool and/or the targeting line on a by-chance or round-robin (or other sequential) basis.

Next, after the symbols targeting line (e.g., 1039') has been defined, after the line-transforming tool 1012*c* (e.g., a razor blade) has been picked and after the initial series of symbols (e.g., K, A, J, Q) have settled into position and their respective attributes have been determined, the line-transforming tool 1012*c*' is applied sequentially, for example in direction 1013, along the symbols targeting line (e.g., 1039', but does not necessarily have to be a straight or horizontal line) so as to transform the initial series of settled symbols (e.g., K, A, J, Q) according to the nature of the tool (e.g., a razor blade tries to slice vertically through the symbols and also optionally according to the by-chance or round-robin assigned natures of the initial series of settled symbols (e.g., fruit like, wood-like, metal like, sponge-like etc.).

In the illustrated example of FIG. 1B, arrows 1019 represent the sequential left-to-right transformations of the line-targeted symbols into razor cut 3D remnants from which respective prizes, virtual juices, nulls and/or special effects pour or squirt out. Item 1012*c*" represents the displayed position of the line-transforming tool after it has finished operating on the line-targeted series of symbols. In other embodiments, the line-transforming tool may move from right to left or may apply its symbols transformation attempts simultaneously to all the line-targeted series of symbols. Cutting apart of the initial series of settled symbols (e.g., K, A, J, Q) to reveal internal gains or other effects is just one example of symbol transformation. Other along-the-line transforming tools (e.g., fire hoses, flame throwers, etc.) may cause an upgrading of some or all of the line-targeted series of symbols to enhanced substitute symbols. For example, the initial series of settled symbols; K, A, J, Q may be transformed into an all Aces series, AAAA (not shown) by application of a thumbs-up like, line bumping tool (shown dashed in the tool box), or into an all Wilds series, WWWW (not shown) by a wild-beast tool (not shown). As yet another example, some or all of the initial series of settled symbols; K, A, J, Q may be transformed into second-chance spin wheels (not shown) where the outcomes the second-chance spin wheels can provide the player with additional gains.

In the illustrative example of FIG. 1B, the vertically sliced open initial symbols (e.g., K, A, J, Q) are displayed as containing fluid-like prizes, juices, nulls and/or pleasing effects. This is a kin to biting into a chocolate covered confection for surprise discovery of what lies inside. Each sliced open segment of an initial symbol may contain its own respective content. In one embodiment, so-called prizes automatically convert into monetary or credit gains. Juices, on the other hand can spill by chance onto nearby other symbols and provide value-enhancing transforms to those spilled upon other symbols. In one embodiment, the spilt on symbol must be on an active pay line (a currently wagered upon pay line) in order for the spilt juice to have effect. Some of the sliced open symbols may by chance have no gain-producing content (null contents). On the other hand some of the sliced open symbols may by chance fail to provide gain-promising content but may nonetheless provide some sort of visual or auditory reward, for example in the form of displayed fireworks and/or music. Thus, the player receives some sort of surprise reward although not one that leads to monetary or credit gains or further chances for such.

Figure 1C:
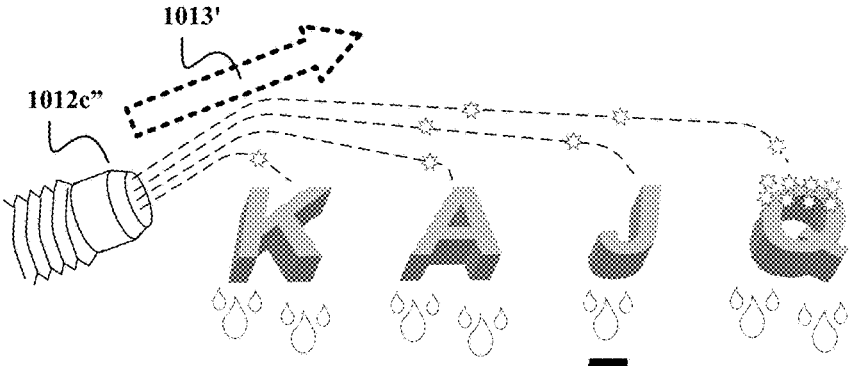
FIG. 1C illustrates a possible awards unleashing action when a line washing tool (e.g., fire hose) is selected by-chance as a multi-symbol transforming tool.

FIG. 1C depicts the picking of a different tool 1012*c*"; which in the illustrated case is a nozzle or hose end which discharges a transformative substance and/or effect on to the symbols of the multi-symbol transformation (MST) target line. The direction of the discharge is represented by symbol 1013'. The discharge can be displayed in the form of a fluid or flames or particles embedded in the displayed discharge. The effects of the nozzle discharge on the initial symbols (e.g., K, A, J, Q) may be additive and/or subtractive. For example, if additive as shown over the initial Q symbol, a new upgraded symbol (e.g., Wild) may build up on top of the lower layer due to accumulation of particles supplied by the discharge from the picked MST tool 1012*c*". If there is a subtractive aspect to the tool discharge, this may result in dissolving away of parts of the initial symbol (e.g., the J symbol) and/or release of enhancing juice for dripping or squirting onto a nearby other symbol (e.g., the "5" symbol) whereby that other symbol can receive a transformative and enhancing effect due to the type and/or amount of juice(s) spilt onto it. (For example, if enough juice spills on the "5" symbol, it may transform into a Wild symbol.) Due to picking of different MST tools and/or different MST target lines and/or different textures for the initially settled symbols; different and surprising results may arise so as to give players an expectation of additional and varied gains and a sense of additional excitement from not knowing exactly what will happen each time.

Next, referring to FIG. 2, further details of one embodiment of the network services providing portion 1004 and of gaming machine operations are described. In FIG. 2, gaming system 1050 includes three banks of gaming machines, 1052*a*, 1052*b* and 1052*c*. For purposes of illustration, three side-by-side gaming machines are shown in each bank although a different number could be used (e.g., 4, 5, 6 etc.).

The network services providing portion 1004 includes a central determination server 1054, a local progressive server 1056, a wide area progressive server 1058, a player tracking/slot accounting system server 1060 and ticket-in/ticket-out (TITO) server 1062. In gaming system 1050, all of the gaming machines in each bank, 1052*a*, 1052*b* and 1052*c*, are operatively coupled to the slot accounting system server 1060 and the TITO server 1062. However, only the gaming machines in bank 1052*a* are coupled to the central determination server 1054. Further, only gaming machines in bank 1052*b* and display 1068 are coupled to the local progressive server 1056. Finally, only the gaming machines in bank 1052*c* are coupled to the wide area progressive server 1058. The communication couplings between the gaming machines in each bank and the servers 1054, 1056, 1058, 1060 and 1062 can be wired connections, wireless connections or various combinations/permutations thereof.

In various embodiments, the central determination server 1054 can be used to generate a controlling portion of the game played on the gaming machines in bank 1052*a*. For example, the central determination server 1054 can be used to generate random numbers used to determine outcomes to the games played in bank 1052*a*. In another example, the central determination server 1054 can be used to generate all or a portion of the graphics used during play of the games on the gaming machines in bank 1052*a*. For instance, the central determination server 1054 can be configured to stream a graphical presentation of a game to a gaming machine, such as that of upper display graphics 1064 and/or of the gaming machine's lower displays. (Lower displays not numbered here because primary player 1062*a* is illustrated obstructing those further displays.) The streamed upper display graphics 1064 may include that which on occasion (e.g., randomly or pseudo-randomly) reveals an active special bonus transformation indicating symbol 1012*e* (e.g., RAZOR CUT++), reveals the awarding of a number of extra gains due to application of a selected MST tool and reveals a possibility of a further and optionally better MST tool being present for selection the next time that the special bonus transformation indicating symbol 1012*e* re-appears. The streamed graphical presentations can be output to respective displays on respective ones of the gaming machines.

In one embodiment, the central determination server 1054 can be used to generate numbers used in a bingo type games played on the gaming machine in bank 1052*a*. These bingo type games are often referred to as class II games whereas traditional slot machines are referred to as class III games. In class II games, a draw of numbers is made. The numbers can be mapped to a bingo card, which the player purchases to play the bingo game. The draw of numbers can result in at least one winning game combination on the bingo cards participating in the current bingo game.

The central determination server 1054 can be configured to repeat the number draws for the bingo games at regular intervals. For example, number draws can be repeated every 20 milliseconds. Players at the various gaming machines coupled to the central determination server 1054, such as the players at the gaming machine in bank 1052*a*, can initiate bingo games which utilize the bingo numbers from a particular bingo number draw. The bingo numbers in the number draw can be mapped to a bingo card displayed on the screen of the gaming machine, such as 1064.

Wins can be indicated by a winning pattern on the bingo card, such as four in a row or four corners. In response to a winning pattern on a bingo card on a particular gaming machine, the central determination server 1054 can send a prize amount associated with the win to the gaming machine with the winning pattern. This prize amount can be displayed on the gaming machine and the credits associated with the prize amount can be deposited on the gaming machine. For example, win of a bingo game on gaming machine 1064 can result in a prize amount being displayed on the main display. Further, the prize amount can be deposited as credits on the gaming machine 1064 such that the credits are available for additional game play.

In one embodiment, the prize amount can be output to look like a slot game. For example, if the prize amount is ten credits. Video reels can be displayed spinning on a main display of the gaming machine and a reel combination associated with a ten credit win in a slot game can be output to the display screen. If the outcome to the bingo game on a particular gaming machine is no award, then the video reels can be displayed spinning and a reel combination associated with no award in the slot game can be displayed on the gaming machine. This process can be repeated on various participating gaming machines, as number draws for various bingo games are initiated and completed on the central determination server 1054.

The local progressive server 1056 can be used to generate one or more progressive prizes that are limited to a local group of gaming machines, such as only the gaming machines in bank 1052*b*. When games are played on the gaming machine in bank 1052*b*, an amount of each wager can be contributed to one or more progressive prizes. The local progressive server can receive the contribution amounts from the gaming machines linked to the progressive game and can keep track of the prize amounts associated with the one or more progressive prizes. The prize amounts for the one or more progressive prizes can be output to displays on the participating gaming machines as well as to separate displays near the participating gaming machines.

The local progressive server 1056 can be configured to receive information regarding gaming events on the participating gaming machines. For example, the local progressive server 1056 can be configured to receive a notification from each of the participating gaming machines when a game outcome has occurred associated with a win of a progressive prize. In other examples, the local progressive server can be configured to receive gaming information, such as when each game is played on one of the participating gaming machines, an amount of wagered for each game and when one or more type of game outcomes occur on each of the gaming machines.

The gaming information associated with gaming events on the one or more gaming machines can provide a basis for additional bonus scenarios. For example, a bonus award can be triggered on one of the gaming machines after a random number of games are played on the gaming machines as a group. As another example, a bonus award can be triggered on one of the gaming machines after a particular game outcome occurs a random number of times on the participating gaming machines as a group, such as a particular combination of symbols appearing a random number of times.

The wide area progressive server 1058 is connected to the gaming machines in bank 1052*c* and display 1066. The wide area progressive server 1058 can be used to enable a progressive game played on gaming machines distributed over a wide area, such as multiple casinos distributed within a state. Similar to the local progressive server 1058, when wagers are made, the wide area progressive server 1058 can receive contributions to the progressive prize from the participating gaming machines. The wide area progressive server 1058 can report these contributions to a remote device which tracks the total progressive jackpot. Further, if a progressive jackpot is won on one of the gaming machines to which it is connected, the wide area progressive server 1058 event can be reported to the remote device. Yet further, the wide area progressive server 1058 can receive a current progressive jackpot amount from the remote device. The current progressive jackpot amount can be reported on displays on the gaming machines participating in the progressive jackpot and/or nearby signage, such as 1068.

An exemplary display 1068 of yet another gaming machine or other display device (e.g., wide area display device) can have a digital sign controller 1070. The digital sign controller 1070 can have a network interface which allows it to communicate with a remote device, such as the wide area progressive server 1058. In this example, the digital sign controller 1070 can be configured to output information to display 1068 associated with the progressive game, such as a current jackpot amount.

In general, displays with digital sign controllers can be provided through out a gaming environment, such as casino. The digital sign controller, such as 1070, can be configured to communicate with a remote device. The remote device can be configured to send information to the digital sign controller to output to a display. The information can include video, audio and picture data. Further, the remote device can be configured to send commands to the display, such as a command to output information to the display. In one embodiment, the wide area display devices (e.g., 1068) may provide announcements of when particular gaming machines (e.g., 1002) in the local area have awarded beyond a predetermined threshold number (e.g., 5) of full line gains due to application of MST tools (e.g., razor blades, effects discharging hoses, symbol upgrading boxing gloves (with thumbs up) etc.).

The slot accounting system portion of server 1060 can receive accounting information from each of the gaming machine in system 1050, such as an amount wagered for each game and amounts awarded on each gaming machine and/or the number of further extra gains awarded due to application of MST tools to the initially settled upon outcome combinations (e.g., K, A, J, Q). The server 1060 can also receive information which uniquely identifies each gaming machine including a machine ID number and a current game being played on the gaming machine. The accounting information can be used for auditing purposes.

The player tracking system portion of server 1060 can track the game play of individual users. For example, a player can input account information into one of the gaming machines that is associated with a player tracking account that has been previously set-up. Based on the account information, a particular player tracking account can be located. The player tracking account can include information which identifies an individual user, such as user 1062*a* (User 1062*a* can be playing games at one of the gaming machines in bank 1052*a*.). The player tracking account information can include a player's name, address, phone number, gender, etc. It is to be understood that the graphics presentations on any given gaming machine can be structured for entertainment and heightened emotions and/or expectations of not only the primary player 1062*a* but also for that of nearby other persons 1062*b*.

In one embodiment, a player, such as user 1062*a*, can insert a player tracking card in a card reader (e.g., see card reader 1022 in FIG. 1). The card reader can read player tracking account information from the player tracking card, such as on a magnetic strip on the card, and send the information to the player tracking/slot account system server 1060. Based upon the received player tracking account information, the player tracking system portion of server 1060 can locate a player tracking account.

The player tracking account information can be input via other means on the gaming machine. For example, as shown in FIG. 1, the gaming machine 1002 may be able to communicate with a mobile device, such as 1006. Thus, in one embodiment, the gaming machine 1002 may be configured to directly receive player tracking account information from a mobile device. In another embodiment, the gaming machine 1002 may be configured to generate an input interface on a touch screen display that allows a player to input player tracking account information.

After the player provides account information and an account is located, the player tracking system can enter accounting information associated with a player's game play into the identified player tracking account, such as an amount wagered over time. As described above with respect to FIG. 1, the accounting information associated with a player's game play can provide a basis for awarding comps to the player. For example, based upon a player's previous game play, the player tracking system portion of server 1060 can send an amount credits to the gaming machine on which the player is playing. In another example, the player tracking system portion of server 1060 can send a command to a printer (e.g., see 1022 in FIG. 1) on the gaming machine on which the player is playing to print out a ticket. The ticket can be redeemable for goods or services or a discount on goods or services, such as a free meal or discount a meal.

As described above, each of the gaming machines can be coupled to a ticket-in/ticket out (TITO) server 1062. TITO server 1062 can be used to generate and validate instruments associated with a credit and/or cash value. One example of an instrument, which can be generated and validated, is a printed ticket. Another example is a digital instrument, such as a printed ticket stored in a digital form. In one embodiment, a digital instrument can be stored on an electronic device carried by a user, such as a mobile device carried by user 1062*a*.

As an example, when a printer, such as 1022, is employed in a "cash out," the gaming machine controller (e.g., see 1160 in FIG. 8) can contact a TITO server (e.g., see 1062 in FIG. 2) with a cash out amount. In response, the TITO server can generate a unique number, associate the unique number with a value and send the gaming machine a unique number. The unique number can be sent to a printer (e.g., see printer 1022 in FIG. 1). Then, the printer can print a ticket with the unique number, such as a unique number encoded in a bar-code, and a value of the ticket, such as five dollars.

When the ticket is later presented for redemption, the unique number can be used to validate the ticket. For example, the user 1062*a* can "cash out" at a first gaming machine, such as 1064 in bank 1052*a*, and receive a printed ticket with a unique number generated by the TITO server 1062. Then, the user 1062*a* can go to a gaming second gaming machine, such as 1066 in bank 1052*c*, and insert the ticket into a bill acceptor (e.g., see 1024 in FIG. 1). The second gaming machine 1066 can contact the TITO server 1062 and send the ticket information, i.e., the unique number read from the ticket, to server 1062. Then, the server 1062 can validate the ticket and send back to the second gaming machine 1066 an amount of credits to deposit on the second gaming machine. The deposited credits can be used for additional game play.

In these examples, the servers can include processors, memory and communication interfaces. Various gaming functions are associated with each of the servers, 1054, 1056, 1058, 1060 and 1062. The described distribution of gaming functions is for the purposes of illustration in only. In alternate embodiments, combinations of gaming functions can be combined on the same server or repeated on different servers. For example, the central determination server 1054 can also be configured to provide a local progressive to the bank of gaming machine 1052*a*. In another example, the local progressive server 1056 can be configured to provide a number of different progressive prizes for different groups of gaming machines. In yet another example, the player tracking system portion of server 1060 can be configured to provide bonusing features at each of the gaming machines.

In FIG. 2, while gaming machines, such as those of displays 1064 or 1066, are operational, a user such as 1062*a* can engage in game play. Under some conditions, such as tilt conditions, game play can be suspended and an intervention by an operator, such as 1065, may be required. An operator intervention may require an operator, such as 1065, to be directly present at a gaming machine, such as that of display 1064. For example, the presence of an operator may be required to access an interior of the gaming machine to clear a tilt condition. In other examples, an operator may be able to clear a tilt condition from a remote location via a near field or other communication coupling with the gaming machine (e.g., using a mobile device such as 1006).

In one embodiment, during game play, the gaming machine can award an amount above some threshold amount. Prior to receiving the award, an operator, such as 1065, can be sent to the gaming machine to have the player fill out a form for tax purposes. In the United States, this tax form is referred to as a W2G form. In addition, the operator may verify that the gaming machine was operating properly when the award was made prior to the player receiving the award. For example, if the gaming machine indicates a progressive jackpot has been won, the operator may check to verify the gaming machine was operating properly. In a hand pay, the operator, such as 1065, may provide an instrument redeemable for the jackpot amount.

As described above and in more detail with respect to FIGS. 1, 8 and 9, an operator, such as 1065, may be required to be physically present at a gaming machine, such as 1064 and 1066, to clear a tilt condition. For example, to clear a tilt condition, the operator, such as 1065, may have to access an interior of a gaming machine to clear a paper jam in a printer or a bill acceptor (e.g., see printer 1022 and bill acceptor 1024 in FIG. 1). In another example, to clear a tilt condition, the operator 1065 may have to access an interior of the gaming machine, such as 1064, to add more tickets to a ticket printer or empty a note stacker associated with the bill acceptor. For some tilt conditions, the gaming machine operator 1065 may access a menu output on a main display of the gaming machine, such as 1064 or 1066, to perform a RAM clear. RAM clears are described in more detail below with respect to FIG. 8.

Figure 3A:
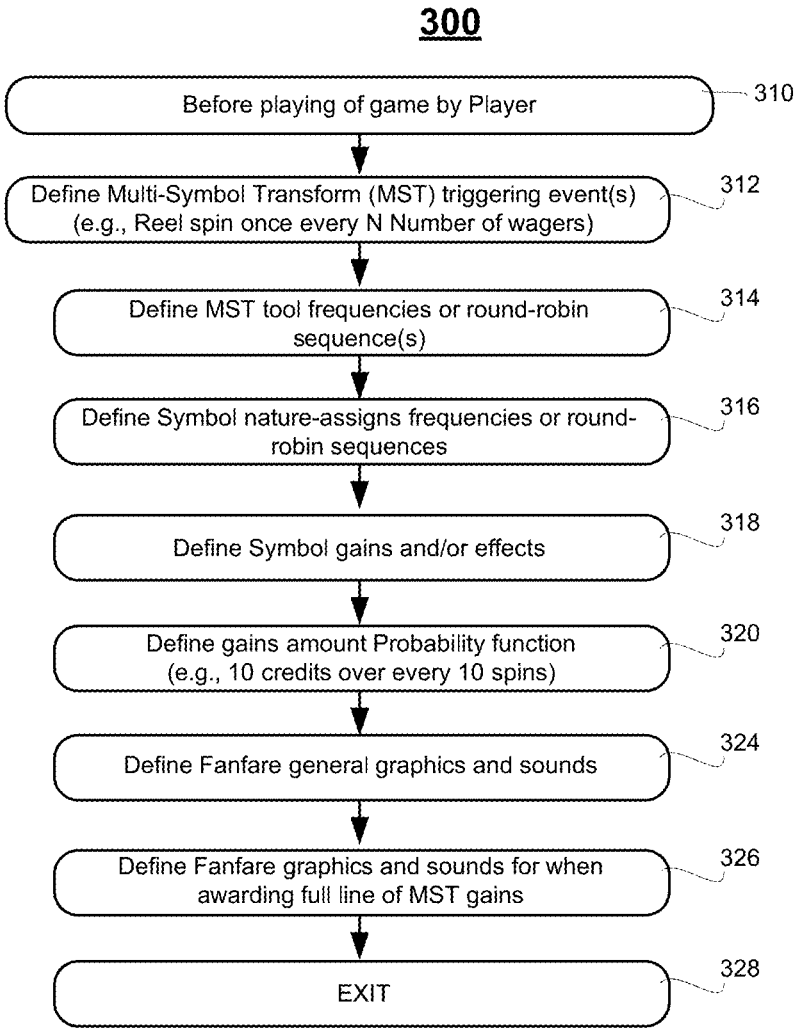
FIG. 3A depicts a machine-implemented method of configuring a wagering system to provide a multi-symbol transformation option using a multi-symbol transforming tool in accordance with the present disclosure.

Referring to FIG. 3A, shown is a machine implemented automated process 300 for initiating one or more games that implement multi-symbol transformation (MST) in accordance with the present disclosure. It is to be understood that all or parts of the exemplary process 300 may be carried out by one or more of a plurality of instructable electronic processors in accordance with non-transitory instructions stored in a corresponding one or more non-transitory memories. As indicated in step 310, this initializing process is carried out before the playing of one or more MST-enabled games by a respective player. In step 312, definitions are established for when chances or opportunities for multi-symbol transformation (MST) will be triggered. It is within the contemplation of the present disclosure that one or more of a variety of triggering events can be defined. The triggering events can include by-chance and/or round-robin display of an MST targeting line and/or an MST tool or display of mechanisms that will subsequently allow for generation of a corresponding MST targeting line and/or an MST tool. Opportunity for MST-based gains may be predicated on a certain number of wagered games having been previously played by the player and/or on other conditions including chance outcome by a reel spin once every predetermined number of wagered games.

In one embodiment, the machine automatically picks the MST tool and step 314 determines the probability frequencies and/or round robin pick sequences for picking respective ones of the tools. In an alternate embodiment, the player is allowed to pick the MST tool prior to settlement of the initial symbols. In the latter case, step 314 determines which tools will be made available to the player for player selection where the display tools in the toolbox appear based on an initialization determined probability frequency or round robin sequence.

In one embodiment, as the initial outcome symbols settle into place, those on an MST targeting line are transformed to have a specific outer skin and/or other characteristic that affects the ability of the picked MST tool to transform the respective symbol. In such cases optional step 316 defines the natures to be assigned to the respective symbols and the probability frequencies and/or round robin sequences to be used for such assignments.

In step 318, the initiation process predefines the respective gains and/or other effects or immunities that will result from each symbol (optionally each nature assigned symbol) when each respective MST tool attempts to apply its transformations to that respective symbol.

In step 320, the initiation process defines either fixed or by-chance amounts of prizes and other gains to be awarded when MST transformations take place. The by-chance amounts may be determined using an initiation-defined probability function with appropriate constraints; for example awarding no more than ten credits over every ten spins.

In one embodiment, each time an MST opportunity arises (wherein an MST tool has or will be picked, an MST targeting line has or will be picked), the machine system produces corresponding fanfare graphics and/or sounds to bring attention to the occurrence of such an MST opportunity. Step 324 defines the fanfare affects to be used for each time an MST opportunity arises. Not every MST opportunity will result in the awarding of a maximum amount of gains across the entire MST targeting line. For example some of the initial symbols along the MST targeting line may be immune to the selected MST tool (e.g., a metallic symbol will resist being cut by the razor blade). Accordingly, when all the initial symbols of an entire targeting line are successfully transformed into gains, that is a special event. Step 326 defines the special fanfare that will be used when gain-producing transformation of the full line of MST targeted symbols occurs. Although the exemplary process 300 is shown to have an exit at step 328, it is within the contemplation of the present disclosure that other aspects of multi-symbol transformation (MST) may be defined during the initialization process.

Figure 3B:
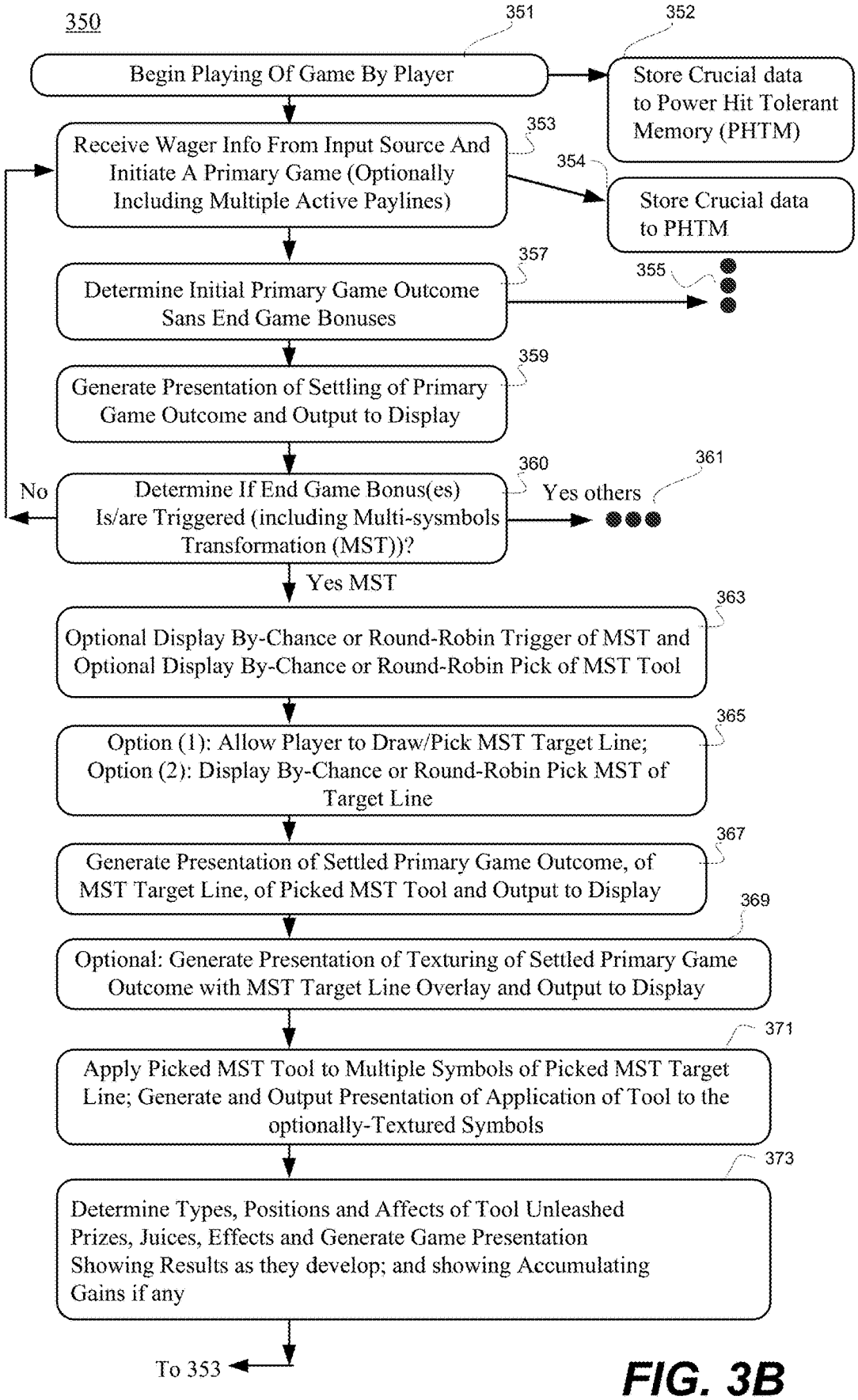
FIG. 3B illustrates a machine-implemented method that includes a multi-symbol transformation operation using a multi-symbol transforming tool selected and operated in accordance with the present disclosure.

Referring to FIG. 3B, shown is a machine implemented automated process 350 for implementing multi-symbol transformation (MST) during the playing of a respective game in accordance with the present disclosure. It is to be understood that all or parts of the exemplary process 350 may be carried out by one or more of a plurality of instructable electronic processors in accordance with non-transitory instructions stored in a corresponding one or more non-transitory memories. As indicated in step 350, the beginning of a playing of a game occurs in step 351. All critical information for preserving the game and continuing it after unexpected power or other interruption is stored in a power hit tolerant memory (PHTM) as indicated in parallel step 352. In accordance with the present disclosure, such storage of critical information occurs after each nonreversible player selection. Thus there is a parallel storage to PHTM with each nonreversible selection. Step 354 shows another such saving to PHTM. Rather than repeating the same for every step it is to be understood that ellipses 355 represent other such savings to PHTM.

In step 353, the machine system receives wagering information from an input source operated by the player and initiates a corresponding gaming action (e.g., the spinning of symbol containing reels). The initiated gaming action may be preceded by the player having optionally selected a plurality of active pay lines rather than just one pay line. Also optionally, the initiated gaming action may have been preceded by the player selecting or drawing an MST targeting line. Such a preselected MST targeting line may have effect only if an MST tool or MST toolbox is presented to the player after the gaming action begins but before settlement of the initial game outcome (e.g., the K, A, J, Q outcome).

In step 357, the machine system determines the initial game outcome of the primary game without the inclusion of any additional end of game bonuses. (These results, as is true for other critical information is saved into the PHTM as indicated by the arrow into repetition symbol 355.) In step 359, the machine system generates the presentation of the settling of the primary game outcome and outputs this to the display. The player still does not know what the final game outcome is and instead gets a sense that is coming to completion. In step 360, the machine system determines if one or more end of game bonus options are being triggered. It is within the contemplation of the present disclosure that more than one end of game bonus option may be triggered at the same time. The optionally triggered bonus options include the here disclosed option for multi-symbol transformation (MST) with attempted application of a selected MST tool to all the symbols along a selected MST targeting line. Control returns to step 353 if no end of game bonus option is triggered. Control passes to path 361 if end of game bonus options other than MST are activated. On the other hand, if the MST option is triggered (e.g., by chance or on a round robin or other sequential basis) then control passes to step 363.

In step 363, there is optional display to the player of a by chance or round-robin mechanism for triggering the MST option. The purpose of this is to generate excitement for the player by not letting the player know until the mechanism is displayed as having reached a decision as to whether the MST option will be granted or not. In one embodiment there is also an optional display to the user of a by chance or round-robin or other sequential picking of the respective MST tool. The purpose of this is to generate excitement for the player by not letting the player know until the mechanism is displayed as having reached a decision as to which MST tool will be applied. Alternatively, in another embodiment a subset of MST tools are displayed to the player and the player is asked to select one of them. The latter occurs before settlement of the initial game outcome is presented to the player. Accordingly, the player has to guess as to which MST tool might be best before knowing what the initial game outcome is.

Step 365 illustrates another possible option where, before settlement of the initial game outcome is presented to the player, the player is allowed to either draw or pick the MST target line. In one embodiment, the picked MST target line is automatically identified as a wagered upon payline. In one embodiment, the picked MST target line is automatically identified as the a highest wagered upon payline. In one embodiment, more than one MST target line may be picked (or drawn) and a respective MST tool is picked and applied for each respective one of the plural MST target lines. The picking of the respective plural MST tools may be by-chance, on a round robin or other sequential basis. As explained above, the picked/drawn MST target line(s) need not be straight linear or horizontal lines and may instead zigzag among the settlement areas of the primary game outcome display 1018. Alternatively, the machine system picks the MST target line based on chance or round-robin or another predetermined sequence.

At step 367, after the MST target line has been selected and the MST tool has been selected, the system allows display of settlement of the initial outcome symbols so that the player can see which ones if any settled along a picked MST target line. It is to be appreciated that not all games necessarily have a gridlike game outcome. Some may have a scattering of settled symbols where an initial game win may occur simply due to the presence of those symbols in a predetermined area rather than the alignment of specific symbols along a predetermined pay line. The player is preferably informed at this time of any gains that are being awarded as a result of the initially settled symbols (e.g., the K, A, J, Q outcome) but before the bonus transformation is attempted.

At step 369, if the option of adding transformation textures to the respective symbols of the settled game outcome is active, at least the symbols settling on the pre-picked MST targeting line are given their respective textures and/or other assigned nature indications (e.g., attached fruits). The player will therefore see the assigned natures and will get a sense of how the ensuing transformation will play out given the selected MST tool and the selected MST targeting line.

In step 371, the machine system applies the picked MST tool to all of the multiple symbols along the picked MST targeting line, where it is understood that in some embodiments, one or more of the multiple symbols may be immune to the picked MST tool. The result of the application is presented to the player either sequentially, one symbol after the next or all at once or as a mixture of both. This includes the displaying of juices or other such effects being expelled from transformed initial symbols and spilling over to adjacent other symbols for possible enhancement of those adjacent other symbols.

In step 373, the machine system automatically determines the outcomes of the application of the picked MST tool to the multiple symbols along the picked MST targeting line. This includes the determination of the types and positions and effects of tool unleashed prizes, juices, visual effects and presentation showing the additional gains resulting as they develop. In one embodiment, one or more counters display accumulating monetary and credit gains as they develop, optionally with corresponding audio indications. Control then returns to step 353 for next round of wagering.

Figure 4:
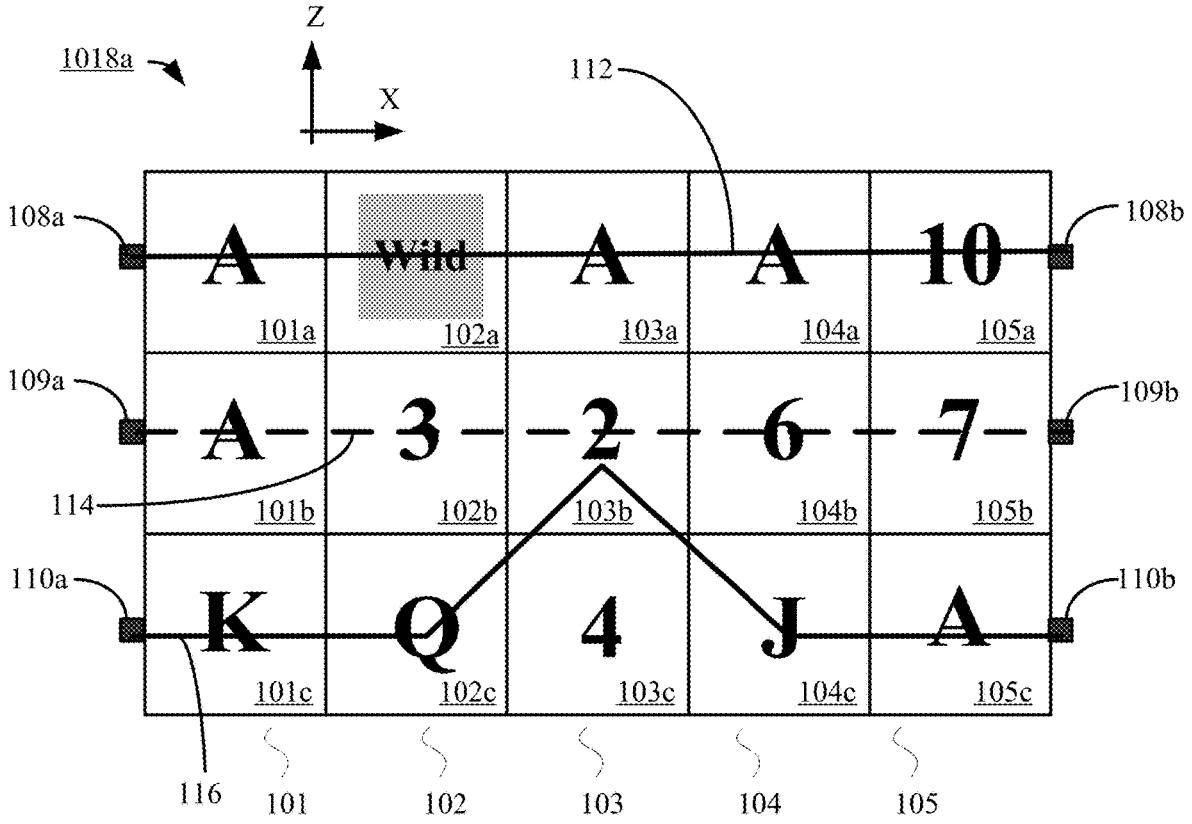
FIG. 4 illustrates possible end-of-game initial outcome presentations in accordance with the present disclosure.

Referring to FIG. 4, shown is an example of a primary game outcome array 1018*a* having a 3×5 grid structure displaying three horizontal rows and five vertical columns. (Other grid configurations are possible, e.g., 4×5, 6×5, 6×6, etc.) Each of the five vertical columns represents the outcome of a respective one of vertically spinning reels 101, 102, 103, 104 and 105. Each reel 101-105 has a plurality of symbol displaying areas, typically populated by randomly selected normal game symbols. In the illustrated example, the symbols mostly correspond to those found in a game of playing cards (e.g., Jack, Queen, King, Ace, etc.). Other symbols may be used depending on the nature of the game. The reel populating symbols may further include a so-called Wild symbol as illustrated for example displayed area 102*a* of the second vertical reel 102. When such a Wild symbol shows up, it may be used to substitute in for another symbol needed for a winning hand along a corresponding payline. Therefore, for horizontal payline 112 which extends as a straight line between respective start and end points 108*a* and 108*b*, the Wild symbol at position 102*a* may substitute in for an Ace symbol ("A") thereby creating a card hand with four Aces in it. In one embodiment, players can determine which and what kinds of paylines will be active during each wagered upon game or spin. For example, a player may have only wagered on the outcome of the central horizontal payline 114 without allowance for scatter, where in the illustrated example that payline 114 displays the spin outcome of "A, 3, 2, 6, 7". In another example the player may have alternatively or additionally wagered on the outcome of a scatter-capable, lower pay line 116 where the scatter capability allows for one deviation into an adjacent outcome row for acquiring a symbol needed for winning the hand. Therefore, in the illustrated example where the player needs a "2" symbol such as is present in cell 103*b* to complete a five card straight consisting of the sequence, "Jack Queen King Ace, 2", the deviation capable pay line skips by the useless "4" symbol in cell 103*c* and instead deviates up into cell 103*b* to complete a potentially winning hand (depending on what specific game is being played and what wagers have been placed).

It is to be understood that for one embodiment, any of paylines 112, 114 and 116 may be automatically picked by the machine system (on a by-chance or sequential basis) or by the player as being the MST target line along which the multi-symbol transforming tool will be applied should the MST option become triggered in accordance with step 360 of FIG. 3A.

Figure 5A:
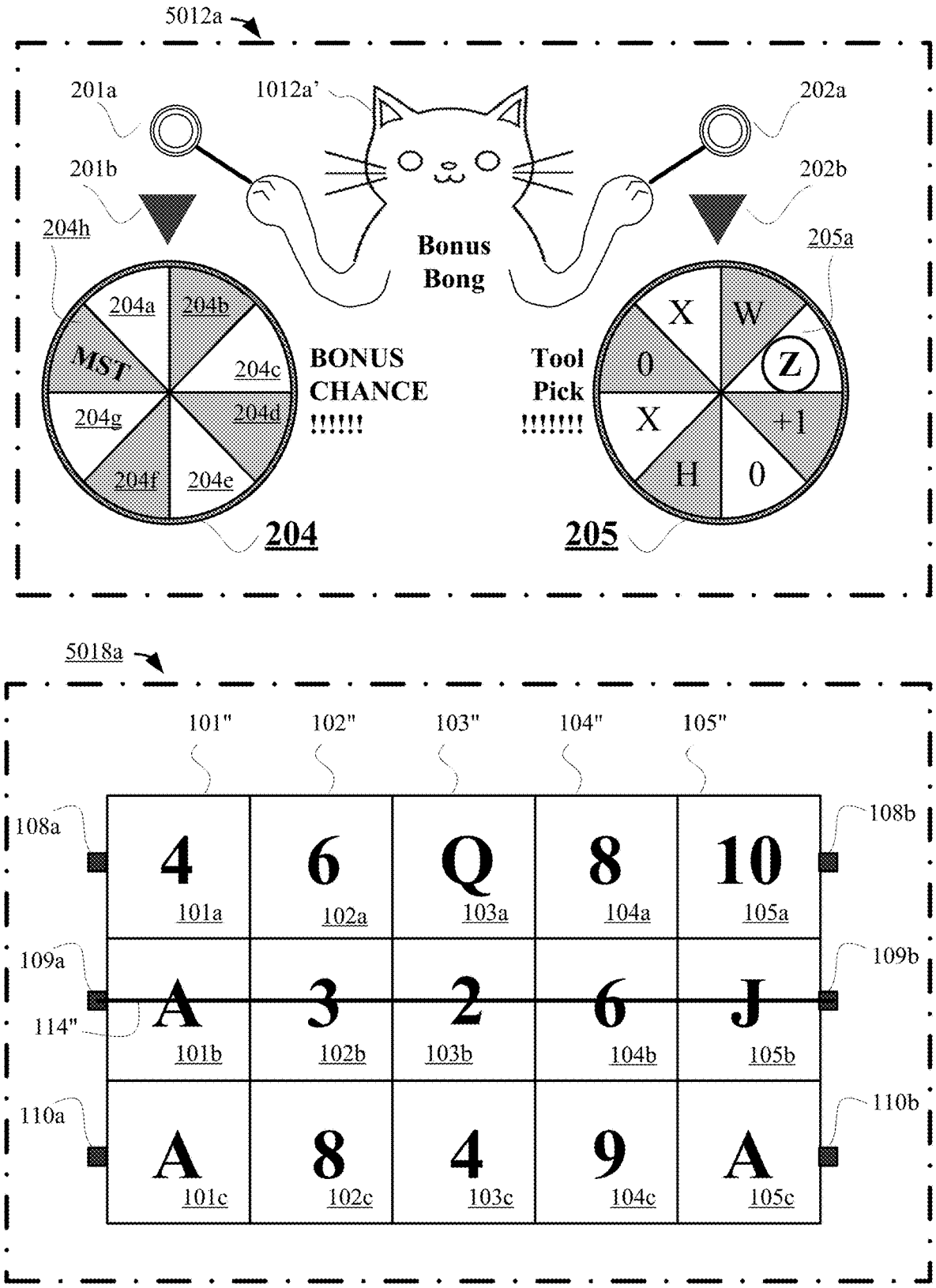
FIGS. 5A, 5B and 5C illustrate various states of a gaming machine system that is configured to allow for possible awarding of end-of-game additional gains including those produced by application of a selected MST tool along a selected MST target line that passes through a plurality of initial symbols of the end-of-game initial outcome presentation.

Referring to FIG. 5A, shown is a state in accordance with one embodiment where a corresponding gaming machine is settling into a determined initial outcome (in primary outcome array 5018*a*) for a wagered upon spinning of the reels. In the illustrated example, only the central payline 114" is active. As seen, it is settling towards a payline outcome having the symbols, "A, 3, 2, 6 and J". However, for this particular embodiment, the gaming machine (or the graphics sourcing server in the network services 1004) has determined that, because this settling state qualifies for a chance at an awarding of a multi-symbol transforming tool (e.g., because at least a predetermined threshold number of wagers in excess of a predetermined threshold amount have been placed by this player on this gaming machine). Therefore, in automated response to automated determining that the current spin is settling, the machine system is programmed to provide notification in the upper display area 5012*a* that a bonus chance at multi-symbol transformation (MST); and optionally at other bonus possibilities, is being initiated. A variety of different ways may be implemented for providing such an announcement, including for example the use of bells or other attracting sounds or graphic effects. In the illustrated example, the Bonus Awarding Friendly Feline 1012*a*' morphs into a state where it is seen holding two strikers, 201*a* and 202*a*. The left side striker 201*a* is positioned above spinning wheel activator 201*b*. The right side striker 202*a* is positioned above spinning wheel activator 202*b*. First, the Bonus Awarding Friendly Feline 1012*a*' strikes the left side striker 201*a* against the left side spinning wheel activator 201*b*. A gong or other such sound may be used to indicate that the first striking has occurred. In response, a left side bonus chance wheel 204 begins spinning. Prior to the spin and/or at a slow start up of the spin, the left side bonus chance wheel 204 allows the primary player (and others nearby) to see that at least one option on the left side bonus chance wheel 204 contains a special symbol (e.g., MST) representing an opportunity for a bonus multi-symbol transformation that can upgrade plural symbols on a corresponding MST target line. In the illustrated example, the special symbol (e.g., MST) is disposed at least in wheel slice 204*h*. Others of the wheel slice positions 204*a*-204*g* may also be filled with symbols or may be blank. The other symbols of wheel slice positions 204*a*-204*g* typically will not include the multi-symbol transformation bonus indicating symbol (e.g., MST) although in an alternate embodiment there may be more than one such special symbol (e.g., MST) distributed among wheel slice positions 204*a*-204*g*. It is to be understood that although the illustrated random spinning wheel 204 is illustrated as having eight wheel slice positions, it is within the contemplation of the present disclosure to have different numbers including more or less than eight and not necessarily all of equal slice sizes (where equal slice sizes indicate equal chances and larger slice sizes indicate increased chance of landing on those slices). Also, although for one embodiment, MST is the only type of end-of-spin bonus opportunity, it is within the contemplation of the present disclosure that in other embodiments, additional other end-of-spin bonus opportunities might be indicated in one or more other slices of the end-of-spin bonus opportunity wheel 204.

Either after the left side bonus chance wheel 204 finishes spinning or even before (for example when the system knows that the left wheel 204 will land on the special symbol (e.g., MST)), the Bonus Awarding Friendly Feline 1012*a*' strikes the right side striker 202*a* against the right side spinning wheel activator 202*b*. A gong or other such sound may be used to indicate that the second striking has occurred. In response, a right side bonus chance wheel 205 begins spinning. Prior to the spin and/or at a slow start up of the right side spin, the right side bonus chance wheel 205 allows the primary player (and others nearby) to see that at least one option on the right side bonus chance wheel 205 contains a generally-high-return multi-symbol transforming tool (e.g., the "Z" tool in this example) that may by-chance be awarded if wheel slice 205*a* is selected by-chance. In the illustrated example, other MST tool pick possibilities may appear in other of the wheel slices of the right side bonus chance wheel 205. In the illustrated example, the other award options have capital letter designations, X standing for the razor blade or other line cutter tool, H standing for the line hosing tool. W may represent a Wild symbols awarding tool. one or more of those other tool pick possibilities may be a disappointing zero (0) value. Additionally or alternatively, some of the wheel slices of the right side bonus chance wheel 205 may be blank or filled with other symbols (e.g., pictures of tools) aside from alphabetic ones representing the possible tools. In an alternate embodiment (not shown), the player is asked to pick a tool enumerated about the right wheel 204 and then the left wheel is spun to see if the MST option 204*h* comes up.

Figure 5B:
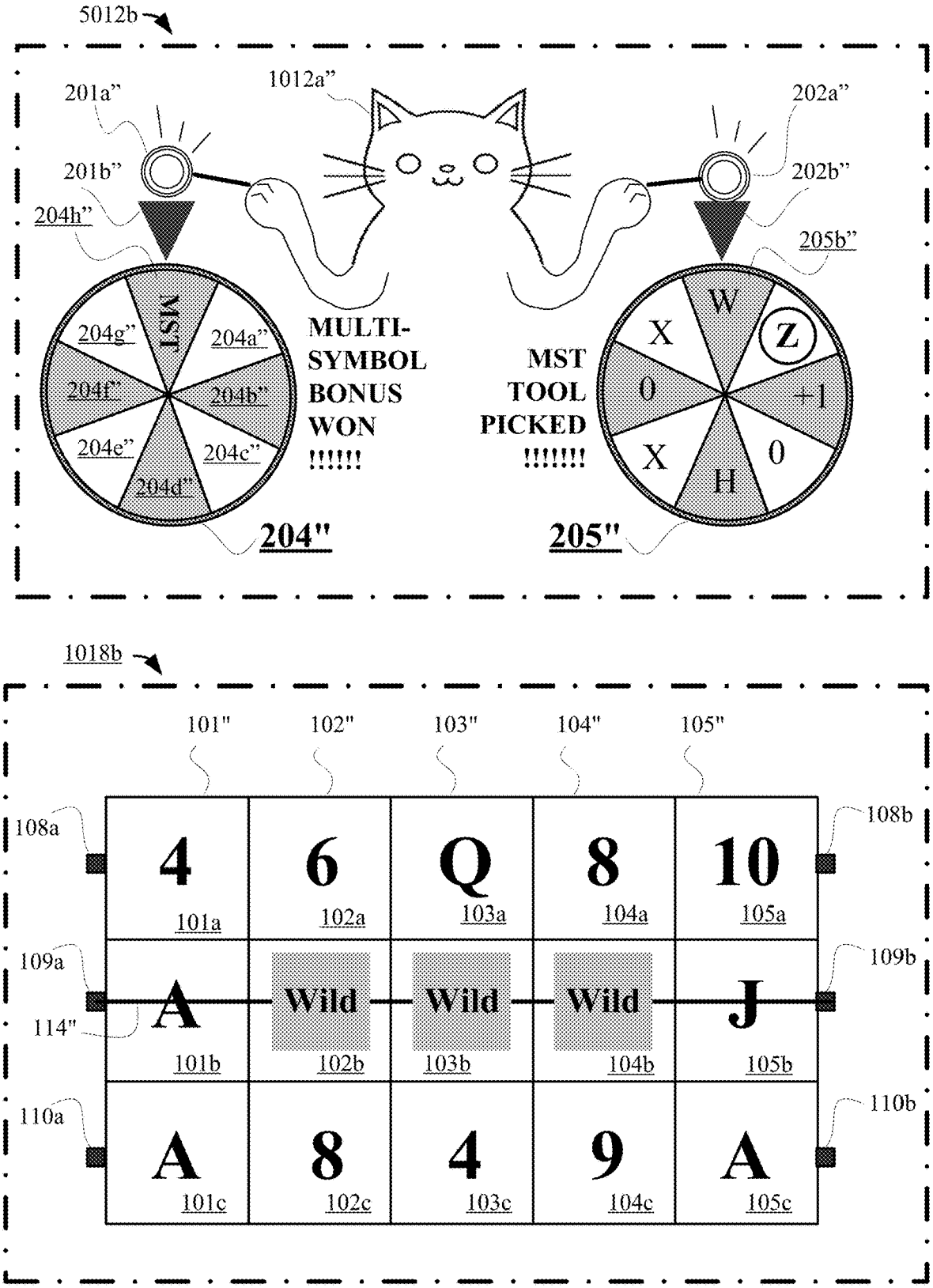

Referring to FIG. 5B, shown is a subsequent state in which the chance wheels of the upper display (now referenced as 5012*b*) have stopped spinning and have produced respective outcomes. The left side bonus chance wheel (now referenced as 204") has stopped with the slice 204*h*" containing the special symbol (e.g., MST) disposed adjacent to award indicating arrow 201*b*". The right side bonus chance wheel (now referenced as 205") has stopped with the slice 205*b*" containing a multi-Wilds awarding tool pick disposed adjacent to award indicating arrow 202*b*". Attractive lights or other notice getting graphics may emanate around the regions of strikers 201*a*" and 202*a*" to indicate that the bonus spin action is complete and optionally to indicate that a multi-symbol transformation tool with generally high return has been awarded. In one embodiment, an image of the picked tool appears in display area 5012*b* near the right side award indicating arrow 202*b*" and then marches down to the left side of the picked MST target line (e.g., 114"). Then the picked multi-symbol transforming tool (e.g., W) is displayed as moving left to right along the picked MST target line and transforming a plurality of the symbols along that picked MST target line (e.g., 114") into Wild symbols. As seen by the settled state outcome of FIG. 5B, the awarded three bonus Wild symbols are all along the picked MST target line (e.g., 114"). Accordingly, the final spin outcome along the central payline 114" has the symbol combination: Ace, Wild, Wild, Wild, Jack which can substitute as an improved symbol combination of Ace, 10, Queen, King, Jack (or another such substituted and better combination).

Figure 5C:
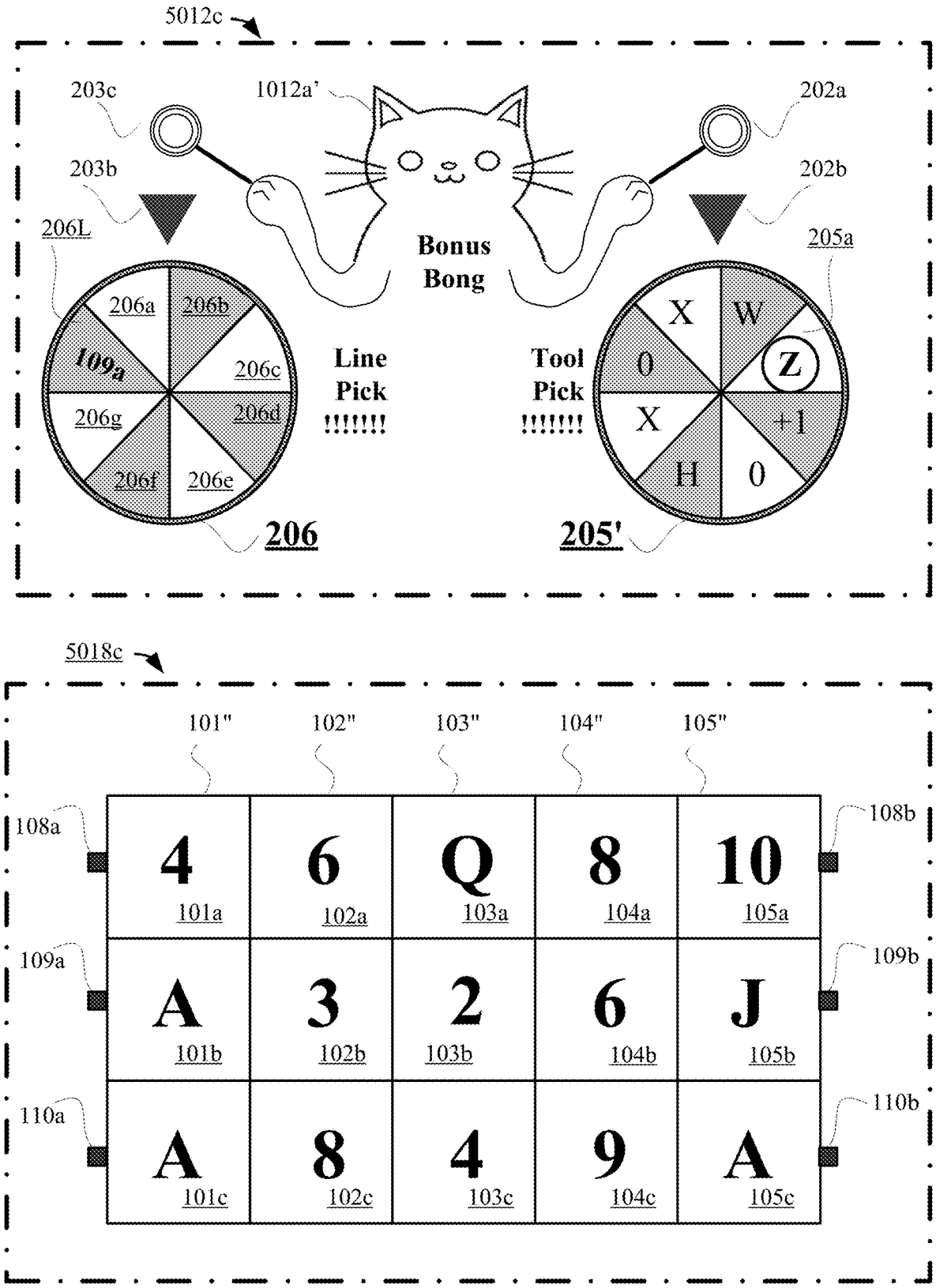

Referring to FIG. 5C, shown is an alternate, by-chance determining of the configuration of the end-of-spin bonus opportunity. Here, wheel 205' is actuated in display area 5012*c* to pick the MST tool (if any) by-chance. The left side wheel 206 however is used to pick the MST target line by-chance. More specifically, wheel slice 206L indicates (if landed on) that starting point 109*a* in display area 5018*c* should be picked as the starting end for a to be drawn MST target line. Others of the wheel slices of target picking wheel 206 may designate other line starting points. In one embodiment, target picking wheel 206 is spun twice; once for picking a starting point and a second time for picking an ending point. As mentioned above, the MST target line does not have to be a horizontal one. In another embodiment, the target picking wheel 206 may be spun more than two times so as to pick intermediate points for a possibly zig zag shaped MST target line, the intermediate points being inside respective cells (e.g., 102*a*, 103*b*, 104*c*, 105*b*) of the primary outcome display area 5108*c*. In yet other alternate embodiments, rather than having the machine system automatically pick the MST tool and/or the MST target line on a by-chance basis or on a round robin or other sequential basis, the player is given an opportunity prior to settlement of the initial gaming action spin to pick from a presented list, at least one of the MST tool and the MST target line. The manual pick presentation mechanism may have an appearance similar FIG. 5C except that the player makes manual choices for example by way of a movable cursor or touch-based movement of the selection wheels 205' and 206.

Figure 6:
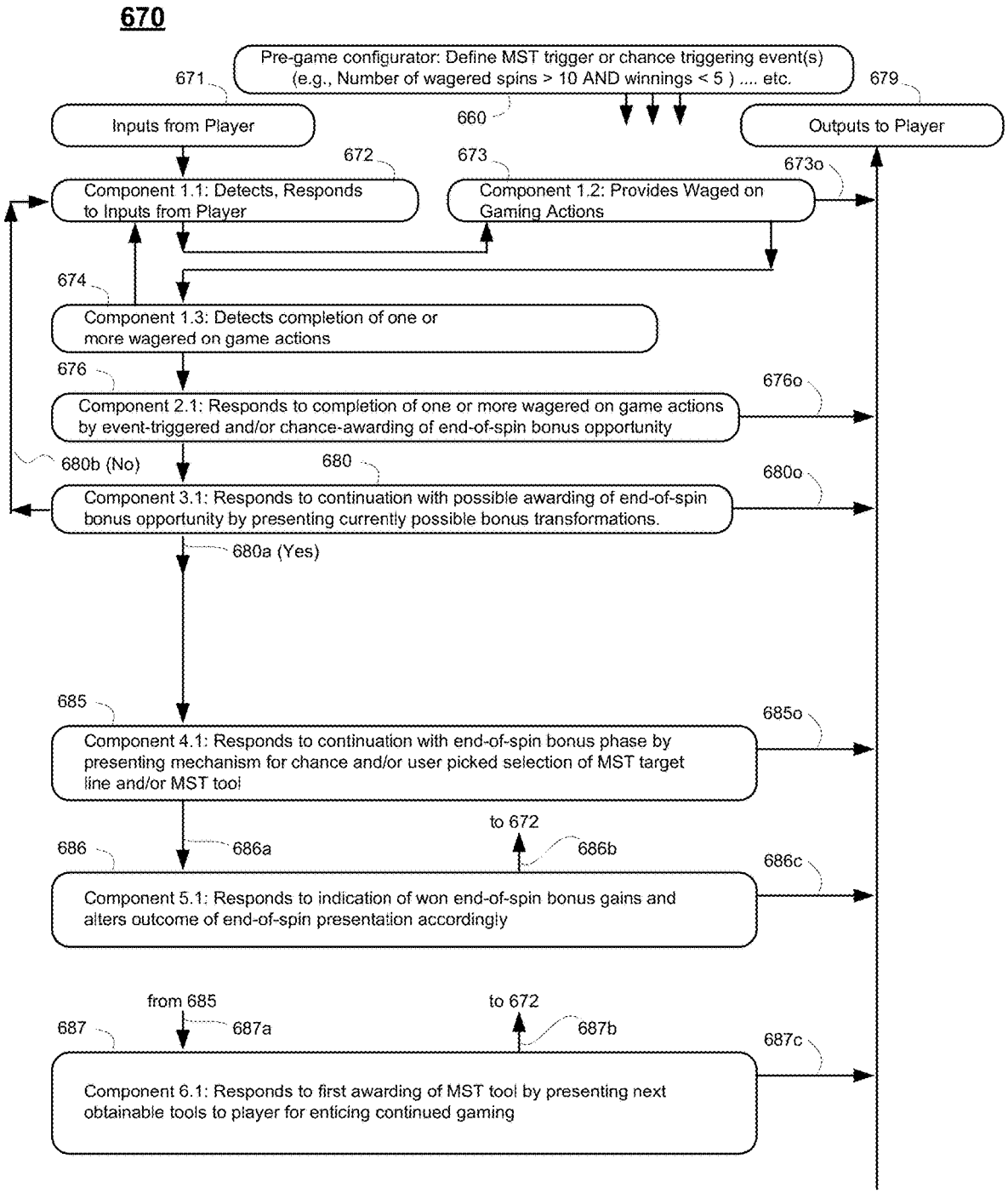
FIG. 6 depicts a machine system configured to provide possible awarding of end-of-game additional gains including those produced by application of a selected MST tool along a selected MST target line in accordance with the present disclosure.

Referring to FIG. 6, illustrated are various components of a machine system configured to carry out one or more aspects of the present disclosure. The components can include mechanical mechanisms and/or electronic mechanisms for providing chance-based game outcomes in particular, the electronic mechanisms may include hardware components, firmware components and/or software instructions encoded into non-transitory computer readable storage and configured to cause an associated one or more processors to carry out the operations defined by those software instructions. More specifically, FIG. 6 depicts a machine system 670 having an initiator component 660 which upon power up or reset establishes initial conditions for various others of the components, for example in accordance with the initial configuration method 300 of FIG. 3A. The components of machine system 670 include one or more player input mechanisms 671 configured for receiving various inputs from the player including those defining desired games to be wagered on. As indicated above, these various input mechanisms may include buttons or touch screens, levers, input devices provided on the player's mobile device (including voice, gesture and fingerprint input recognizing devices).

The components of machine system 670 also include one or more player output mechanisms 679 configured for outputting various signals to the player including those graphically and/or audibly representing the games that are being wagered upon. As indicated above, these various player output mechanisms may include video displays, audio outputs, flashing lights, spinning mechanical wheels or reels, tactile outputs (e.g., vibrators) and so on.

A further or first machine component 672 of system 770 is configured to receive from at least one of the input mechanisms 671, an indication of a player submitted wager. Component 673 is operatively coupled to component 672 to responsively cause actuation of a first gaming action corresponding to the submitted wager. The first gaming action may be output by way of path 673*o* to the player outputs mechanism 679. Component 674 detects completion of each gaming action and signals that completion (except for settling of the gaming action reels as displayed to the player) to both of components 672 and 676. The latter or second component 676 responds to the completion signal by event-triggered and/or chance-triggered awarding of an end-of-spin bonus opportunity. If the end-of-spin bonus opportunity is awarded, component 672 is temporarily blocked from responding to most user inputs until the optional awarding of an end-of-spin bonus completes. (Some embodiments may include a bonus override button where the player chooses to bypass the bonus option.) Presentation of the event-triggered and/or chance-triggered awarding of an end-of-spin bonus opportunity may be supplied to the output mechanisms 679 by way of signaling path 676*o*.

A third of the machine components, 680, is coupled to the second machine component 676 and configured to detect initiation of the event-triggered and/or chance-triggered awarding of an end-of-spin bonus opportunity. One of the possibilities is that no end-of-spin bonus opportunity is to be granted. If that is so, control passes by way of path 680*b* (No) back up to component 672 which is reactivated to receive further wagers from the player. Typically however, the chance of receiving an end-of-spin bonus opportunity is initiated to around 33% and the possible multi-symbol transforming tools include at least one tool (e.g., razor blade) that can transform all the symbols of the picked MST target line into prize-giving or other potential gain-providing objects so that typically, the player will be awarded a plurality of end-of-spin bonus gains. When a chance for end-of-spin bonus gains is being presented (by way of control path 680*a*—Yes) control passes to a fourth of the machine components, 685, which is coupled to the third machine component to detect continuation into the end-of-spin bonus phase and to responsively present one or more mechanisms for chance and/or user picked selection of one or more MST target lines and/or a respective one or more MST tools for respective application to the respective MST target lines. The output of fourth component 685 may be signaled to the player output mechanisms 679 by way of signaling path 685*o*. In one embodiment, the fourth machine component 685 is further configured to, during the continuation with the end-of-spin bonus phase, cause a presentation of one or more, next to be offered MST tools to the player so as to entice the player to keep playing in hopes of being awarded one of those next to be offered MST tools in a subsequent gaming round. In one embodiment, the first gaming action provided by component 673 includes an apparent spinning of chance reels or wheels whose chance settlement outcome can provide a winning combination of symbols along an active payline of the first gaming action. In one embodiment, the wagered on spin gaming actions provided by component 676 includes an apparent spinning of chance reels or wheels whose chance settlement outcome can provide a winning combination of symbols along an active payline. In one embodiment, the spinning of chance reels or wheels may settle to include a symbol indicating that an end-of-spin bonus phase will follow and/or that such an end-of-spin bonus phase will include a multi-symbol transformation opportunity along a picked MST target line.

Illustrated machine system 670 further includes a fifth machine component 686 which is coupled to the fourth machine component to detect if the results include one or more won end-of-spin bonus gains and to alter the outcome of end-of-spin presentation accordingly. Also included is a sixth machine component 687 which is coupled to the fourth machine component to detect the at least one chance offering of the end-of-spin bonus phase and to responsively cause presentation of graphics indicating to the player what multi-symbol transforming tools will be obtainable in next gaming round should the player decide to continue. As indicated in FIG. 6, respective components 685, 686 and 687 have respective output signaling lines 685*o*, 686*c* and 687*c* operatively coupled to the player output mechanisms 679 for optionally outputting their respective results. Completion of actions by components 686 and 687 results in return of control to component 672 by way of respective return paths 686*b* and 687*b*.

The components of the machine system 670 may be housed in a single secured housing (e.g., locked cabinet) or may be distributed in various ways among a plurality of spaced apart and secured locations and coupled to one another by appropriate secured communication links. While a particular arrangement of components is illustrated in FIG. 6, it is to be understood that this is merely exemplary and that operations in accordance with the present teachings may be carried out with use of alternate arrangements of hardware, firmware, software and/or mechanical components.

Figure 7:
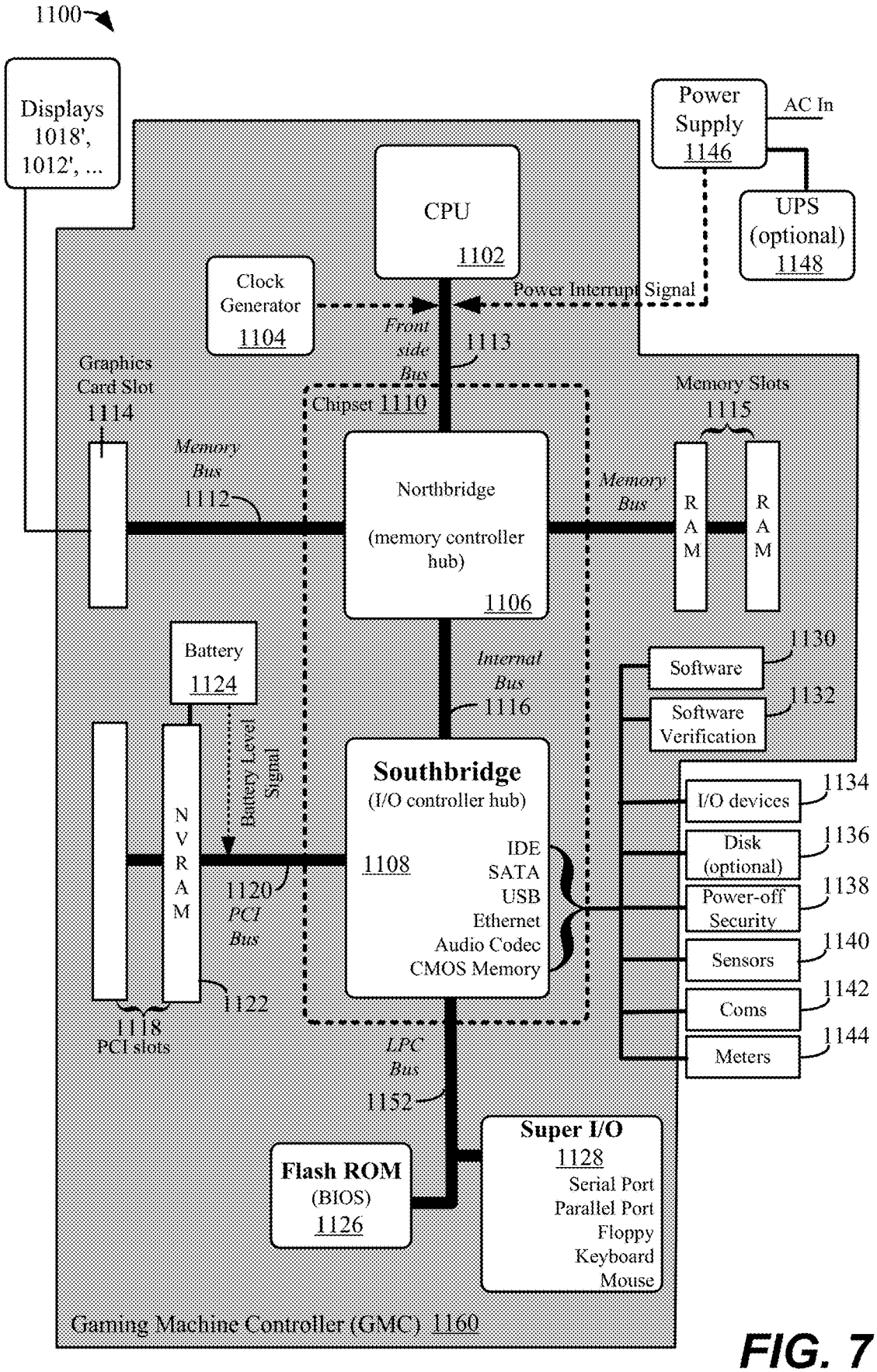
FIG. 7 illustrates a block diagram of gaming machine components including a gaming machine controller in accordance with the present disclosure.
Figure 8:
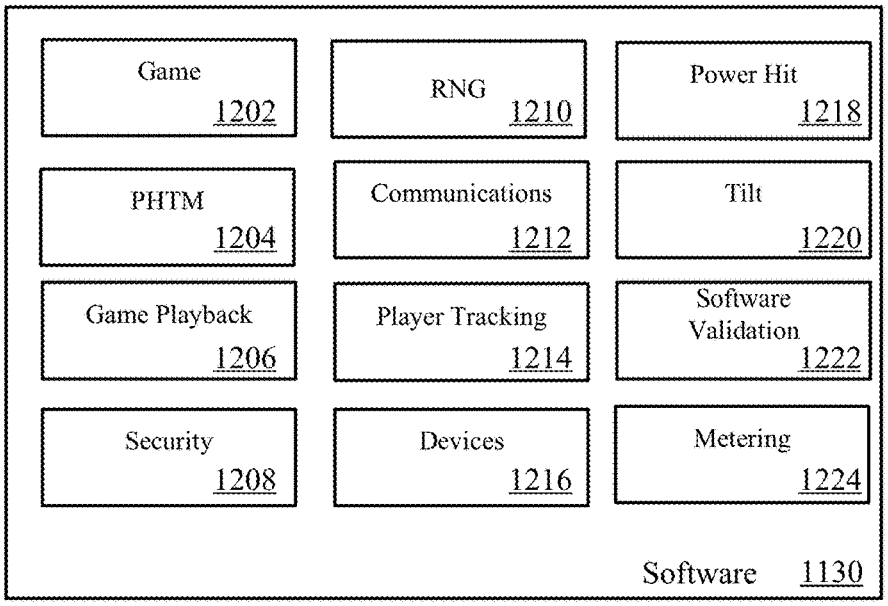
FIG. 8 illustrates a block diagram of gaming software in accordance with the present disclosure.
Figure 9:
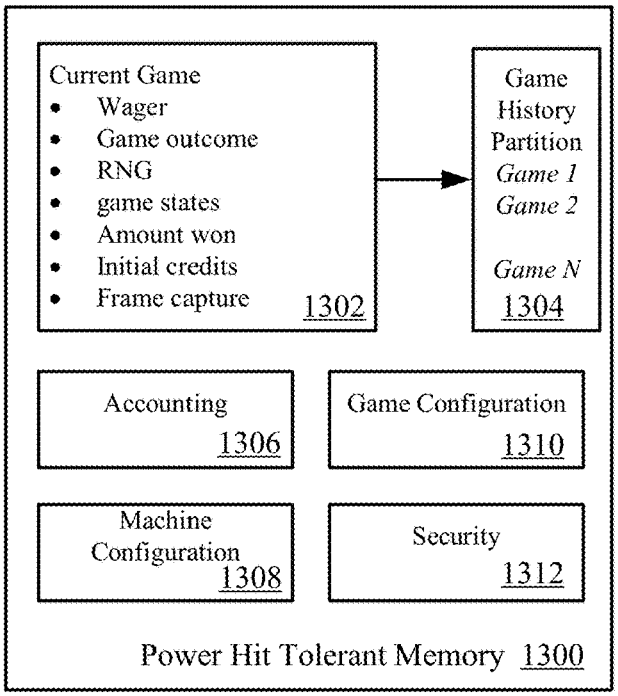
FIG. 9 illustrates a block diagram of power hit tolerant memory in accordance with the present disclosure.

Next, with respect to FIG. 7, details of a gaming machine controller that may be used to control the play of wager-based games including generating the game presentations and controlling the various gaming devices is described. FIG. 8 illustrates a block diagram of gaming machine components including a securely housed gaming machine controller (GMC) 1160. The GMC 1160 can be coupled to an external power supply 1146, displays such as 1018' 1012; etc., I/O devices 1134, external non-transient memories, such as a disk drive 1136, a power-off security device 1138, security sensors 1140, communication interfaces 1142 and meters 1144.

The external power supply 1146 can provide a DC voltage to the GMC 1160. The power supply can also provide power to the other devices in the gaming machine cabinet, such as I/O devices. Typically, the power supply 1146 is configured to receive power from an external power source, such as an AC voltage source. In some embodiments, an uninterruptable power supply (UPS) 1148 can be coupled to the power supply 1146. The UPS 1148 can be configured to provide back-up power for some time period in the event external power is lost. The GMC 1160 includes its own internal and thus securely housed battery 1124 (e.g., a rechargeable battery).

In a particular embodiment, the UPS 1148 communicates with the GMC 1160 on boot up and periodically to indicate power status and battery capacity of the UPS. If the UPS 1148 is not operational, this communication will fail and the game will display a soft tilt on the main game display, such as 1018', indicating that the UPS is not available. Under normal circumstances the UPS 1148 functions to condition the input power and ensure that the UPS battery remains fully charged. However, upon a power failure, the UPS 1148 in conjunction with the game platform will take one of two paths depending on the state of the UPS battery, which are described as follows.

If a power fail occurs and the UPS battery is more that 50% charged the GMC 1160 can immediately determine if there are credits on the machine (The threshold level can be a different percentage). If the game has no credits, the GMC 1160 can immediately hard tilt and become unplayable. The GMC 1160 can continue to run on battery power until either the battery level passes below 50% or power is restored to the game. If power is restored, the hard tilt is cleared and the gaming machine can become playable again.

If credits are on the machine, the GMC 1160 can allow game play to continue until the battery level reaches 50% charge. At that point, the GMC 1160 can complete a game in progress, cash out the player and begin an orderly shutdown. Allowing game play prior to shutting down allows the player to complete a game in progress and continue to remain on the game for a small period of time in case power is restored quickly. This keeps the game from tilting and the GMC 1160 cashing out the player for momentary glitches in power. It also allows some time for backup generators to come on line for a more serious power outage.

The power-off security 1138 can be configured to monitor the security sensors 1140 while power is off to the gaming machine, such as during a power failure or shipping. The power-off security 1138 can include its own processor, memory and power supply, such as the internal battery 1124. The power-off security device 1138 can report detected problems while the power was off to the GMC 1160 after power is restored. In some instances, a detected problem can cause a tilt condition. For example, a detected door open condition while the power was off may cause a tilt condition which has to be cleared by an operator. As another example, if the GMC 1160 can't detect the power-off security 1138, then the gaming machine can tilt.

The I/O devices 1134 can include the gaming devices that are directly or indirectly coupled to the GMC 1160 to provide the external interfaces that allow players to play the wager-based game(s) on the gaming machine. Examples of these gaming devices are described above with respect to FIG. 1. In some embodiments, a memory device 1136, such as disk drive and/or a flash drive, can be provided. As will be described in more detail below, the memory device 1136 can be used as a power hit tolerant memory (PHTM) or used to receive crucial data from another PHTM.

The communication interfaces 1142 can include wired and wireless communication interfaces, which use communication protocols, such as but not limited to Ethernet, Bluetooth,™ Wi-Fi, and NFC. A schematic indication of such a wireless communication interface 1046 is shown in FIG. 1. The remote servers can provide network services 1004 as described above with respect to FIG. 1. The communication interfaces can be used to communicate with remote devices, such as remote servers, mobile devices in proximity to the gaming machine or other gaming machines. The GMC 1160 can be configured to support a variety of communication protocols over these communication interfaces.

In one embodiment, communications can be carried out with a back-end slot accounting system (SAS) (e.g., see network services 1004 in FIG. 1). In one embodiment, the SAS protocol uses a CRC redundancy check to ensure the integrity of messages going to and from the host. All type S, M, and G Long polls are CRC'd over the entire package including the address and command byte. The SAS engine can be configured to isolate the gaming code from the external communications. The SAS engine can be configured to only accept correctly formed SAS messages. Malformed, invalid or incorrect messages can be summarily dropped.

Messages that are valid can be translated into requests for the game player. The result of the message translation can be two-fold. First, the message is parsed and then evaluated for correctness and validity. If the message does not meet this criterion, it may not be translated and forwarded to the game player for a response, such as on display 1026 in FIG. 1. Second, no command, request or message from the external communication interface ever reaches any further than the SAS engine. This process ensures that erroneous signals or data will not adversely affect the game.

The meters 1144 can include hard meters, which are mechanical devices and meters maintained in software by the GMC 1160. In one embodiment, electronic digital storage meters of at least 10 digits that accumulate and store all the meters required can be used. For example, the number of games played since a RAM clear can be accumulated. In a RAM clear, critical memory can be cleared of data. Further, the number of games since the last power-up can be accumulated. As another example, games since the last door close can be accumulated.

Some other functions which may be tracked by a physical or software meter include but are not limited to attendant paid jackpots, attendant paid cancelled credits, bill in, voucher in (e.g., credit voucher), voucher out, electronic fund transfer in, wagering account transfer in, wagering account transfer out, non-cashable electronic promotion in, cashable electronic promotion in, cashable promotion credits wagered, non-cashable electronic promotion out, cashable electronic promotion out, coupon promotion in, coupon promotion out, machine paid external bonus payout, attendant paid external bonus payout, attendant paid progressive payout, machine paid progressive payout, non-cashable promotion credits wagered, number of progressives won, number of jackpots won, number of games won, number of games lost and total amount paid by attendant. Other meters can include main door open, logic door open, cash door open and stacker door open.

In a particular embodiment, software meters can be accessed from an operator menu by turning a key on the side of the gaming machine. The operator menu can be output on display 1150. All software meters can be cleared upon a RAM clear. In addition to the meters, the machine can also display the configured denomination, theoretical payout and actual payout. This information is accessible from the operator menu under the statistics screen. This information can be cleared upon a RAM clear event.

The GMC 1160 is preferably secured within an interior of the gaming machine. For example the GMC 1160 can be contained in a metal box. The metal box can include a secure entry, such as a hinged door, that is lockable. The openings for cables and wiring in the metal box can be purposefully designed to be as small as possible while still allowing proper electrical wiring standards regarding bend radius and connector strain. The locking mechanism for the metal box can be monitored by one of the sensors 1140.

The GMC 1160 can include a motherboard. The motherboard can be the only circuit card that contains control programs. The control programs include those used to control programmable operations within the GMC 1160. Other gaming devices, such as the I/O devices 1134, can include device specific control programs. However, these device specific control programs don't affect or alter the behavior of the control programs on the motherboard.

The mother board can include a chipset 1110. The chipset 1110 can include a Northbridge 1106, which is a memory controller hub, and a Southbridge 1108, which is an I/O controller hub. The Northbridge 1106 and the Southbridge 1108 can communicate via an internal bus 1116.

The Northbridge 1106 can be coupled to a memory bus 1112 and a front side bus 1113. The front side bus 1113 can couple on or more processors, such as CPU 1102, to the Northbridge 1106. The CPU 1102 can receive clock signals from clock generator 1104 via the front side bus 1113.

The memory bus 1112 can couple one or more graphics cards, which include graphical processing units (GPUs), to the Northbridge 1106. The graphics card or cards can be installed in the graphics card slot(s). The graphics cards can be coupled to displays, such as display 1018'. Further, the memory bus 1112 can couple one or more memory slots 1115, configured to receive volatile random access memory, to the Northbridge 1102. The CPU 1102 can communicate with the volatile memory in the memory slots 1115 and the graphics card in the graphics card slot 1114 via the memory bus 1112 and the front side bus 1113.

The Southbridge 1108 can be coupled to one or more PCI slots 1118 via PCI bus 1120. In various embodiments, the Southbridge 1108 can provide a variety of communications interfaces. The communication interfaces include but are not limited to IDE, SATA, USB, Ethernet, an audio Codec and CMOS memory. In addition, the Southbridge can communicate with a flash ROM (BIOS) 1126 and super I/O 1128 via the LPC (Low Pin Count) bus 1152. Typically, super I/O 1128 supports older legacy devices, such as a serial port (UART), a parallel port, a floppy disk, keyboard and mouse. Some of the gaming devices, such as the sensors 1140, can be coupled to the Southbridge 1108 via super I/O 1128.

The GMC 1160 can be configured to execute gaming software 1130 to control playing of a respective one or more wager-based games. On boot-up, software verification 1132 can be performed using logic stored on the BIOS 1126. In some instances, the logic can also be executed on the BIOS. In a particular embodiment, separate hardware device can be installed which includes verification algorithms. The separate hardware device can be coupled to the Southbridge 1108.

In one embodiment, the gaming software 1130 can be stored on two compact flash cards, which are not conventional ROM devices. The verification mechanism can be an SHA-1 hash, which produces a message digest of some length, such as one hundred sixty bits. Message digests can be stored on both compact flash memories and a public/private key algorithm with a key of some length, such as a 512-bit key, can used to encrypt and decrypt the message digests. If any errors are detected in the validation, the GMC 1160 can tilt and halt execution. The GMC 1160 can be configured to prevent programs deemed to be invalid from running.

When the software 1130 is built, it can be hashed using a hash algorithm, such as an SHA-1 hash algorithm. Other hashing algorithms can be used and SHA-1 is provided for illustrative purposes only. The resulting hash answers can form the hash digest. This digest, along with the start and stop values for the validation algorithm, can be encrypted a private key. The key can be stored in a computer which is not connected to any network and which is physically stored in a secure location, such as a locked safe.

In one embodiment, prior to use, the public key can be installed in a power-hit tolerant memory, such as the NVRAM 1122 on the motherboard. This step can be performed when the gaming machine is manufactured. In another embodiment, the public key can be loaded from a memory device, such as a USB device, in the field. In one embodiment, the USB port is only accessible when the enclosure which holds the GMC 1160 is opened. Without a proper public key, the machine will not operate.

When the game initially powers up, the BIOS 1126 can run a Power On Self-Test (POST) and checksum over itself. If these tests fail, the game does not boot and an operator can be required to clear this tilt. If the BIOS self-test passes, the BIOS can retrieve the public key from NVRAM 1122 and can run a CRC over it to ensure it is the correct key. The correct CRC answer can be stored on the BIOS. If the public key does not exist or if the public key CRC returns an incorrect answer, the game can halt and prompt the user to install the correct public key.

Once the public key is validated, the BIOS 1126 can decrypt the SHA signatures for the data stored on the system compact flash 1130 and the start and stop sectors indicating where the data is stored on the compact flash. The data can be stored between the start and stop sectors, inclusive. Unused sectors can be set to 0 (zero). The BIOS 1126 runs a low-level block-by-block SHA-1 hash over the kernel and operating system (Boot and Root) partitions and compares the result to the decrypted file from the manifest. In one embodiment, the operating system can be Linux and the kernel can be a Linux kernel. If the hash values do not match, the game tilts.

If the values match, the BIOS 1126 can load the boot loader program and can relinquish control of the validation process to the boot loader. The boot loader can be executed by the operating system using CPU 1102. The procedure can validate the entire partition, not just the file structure. Thus any unused or unallocated areas of the partition can be tested for unintended programs or data.

Next, a file-by-file SHA-1 can be performed over the paytable, assets, and player files. The resulting information can be compared against the decrypted results from the manifest file. If the calculated answers match the decrypted answers, the GMC will proceed with the boot-up. If the hash answers do not match, the game tilts and requires operator intervention to clear.

In one embodiment, as an additional security measure, a compressed file system that is designed to be read-only can be used. The file system may not support or contain a write command or the ability to write to a file. The file system can be compressed so that it is not human-readable.

Each block of data in the file system can have a corresponding CRC stored with the block. When the block is read, the CRC is calculated and compared with the stored CRC. If the answer does not match, the file system can generate an error and the game tilts. Any changes, whether additions, deletions, or modifications, will change the CRC of the affected blocks and cause the game to tilt. This feature, in effect, monitors the integrity of the entire file system as well as the integrity of the media on a real-time basis.

These SHA hash answers can be available on-screen and may also be accessed via the Gaming Authentication Terminal (GAT) interface. The GAT interface (not shown) can be provided as one of the I/O devices 1134 or within the super I/O 1128. The GAT interface can be configured to allow an operator to initiate an SHA-1 hash or an HMAC SHA-1 on-demand so that an operator (or other independent entity) can validate the integrity of the software 1130 at any time. In one embodiment, a nine-pin "D" connector is available to an operator or regulator for access the GAT serial terminal.

Access to the GAT port requires opening of the main door. Further, it may require unlocking of the GMC enclosure. In one embodiment, a GAT port can be provided on the outside of the GMC enclosure. Hence, the GMC enclosure can remain locked while the GAT port is utilized.

As described above, the gaming machine can include a power hit tolerant memory (PHTM). For example, NVRAM 1122 (nonvolatile memory, for example a RAM coupled to battery 1124) can be used as a PHTM. The PHTM can be used to store crucial data, such as data generated during the play of a wager-based game. The PHTM can be configured to be able to quickly write the crucial data in response to a detection of an imminent power interruption. The CPU 1102 can be configured to detect a potential power interruption via the power interruption signal received from the power supply. The power interruption signal can indicate a fluctuation in the power.

Not all memory types are suitable for use as a PHTM because their write times are not fast enough to store data between the detection of a potential power interruption and the power interruption. For example, disk drives don't typically have fast enough write times for use as a PHTM. In one embodiment, a disk drive 1136 can be used. However, it requires that use of an uninterruptable power supply coupled to the disk drive 1136 and GMC 1160 to maintain power after the external AC power source is lost. Other types of memory with slower write times can be employed when an uninterruptable power supply is used.

Typically, a volatile RAM (random access memory) has a fast enough write speed to be used as a PHTM. However, after the power is lost, data stored in the volatile RAM is lost. To overcome this deficiency, a battery, such as 1124, can be coupled to the RAM 1122 to provide persistence memory storage. This memory configuration can be referred to as a non-volatile RAM (NV-RAM). The battery power levels can be monitored so that it can be replaced as needed. Alternatively or additionally, other forms of nonvolatile memory can be used including for example flash memory, phase change memory, etc.

In one embodiment, an NVRAM 1122 with a battery 1124 is shown inserted in one of the PCI slots 1118. The NVRAM 1122 can be used as a PHTM. In other embodiments, it may be possible to use a RAM inserted into one of the memory slots 1115 that is coupled to a battery. It yet another embodiment, it may be possible to use a high-speed USB connection to a memory storage device to provide a PHTM. As noted above, a hard disk, such as 1136, in combination with an uninterruptable power supply 1148 can be used as a PHTM.

In yet other embodiments, a GMC 1160 may utilize multiple memory storage devices to store crucial data. For example, the NVRAM 1122 can be used as a PHTM. However, crucial data can be copied to a non-PHTM from the NVRAM 1122 as needed. The copied data can provide a back-up of crucial data stored in the PHTM. Further, after crucial data is copied from the PHTM and the validity of the crucial data is verified, it may be deleted from the PHTM to free up space.

In one embodiment, crucial data can be stored in an NVRAM chip and in a high speed read/write compact flash. Crucial data such as RNG outcome, game recall, game state (credits, wager, winnings), and meters can be stored in NVRAM as files. Each file is hashed (MD5 or SHA-1 depending on the file) and the hash answer can be stored with the file.

Additionally, in a particular embodiment, in NVRAM, the critical files can be kept in triplicate with each copy having a separate MD5 hash of the information. Prior to displaying each game outcome, this data can be rehashed and the three outcomes can be compared. If all three hash answers match, the data is deemed to be good and the game results are displayed to the player and a copy is stored in NVRAM. If two of the sets match, the non-matching set is deemed to be corrupt and it is replaced with a copy from one of the other two and the results are displayed to the player. If all three are different, memory can be deemed to be corrupt and a tilt can occur, halting play. The comparisons can occur continuously, each time the memory is updated, which may be multiple times during the course of a single play. However, a comparison can be performed at least once prior to displaying the game outcome.

To protect meters in the event of a power loss, various meters can be stored in NVRAM 1122. Thus, the meters are protected in the event of a power loss. The battery 1124 can be a lithium cell rated, based on the current draw of the NVRAM, to maintain the meters for at least 90 days. In one embodiment, the lithium cell can be rechargeable via the power supply 1146.

In particular embodiments, a game play history associated with recent games can be stored in the NVRAM 1122. This information can be retrieved from the NVRAM 1122 via an operator menu and output to a display, such as display 1018. In particular embodiments, a complete play history for the most recent game played and the nine prior games can be made available. A method involving game play history is described in more detail with respect to FIG. 13.

For a slot game, the game play history can include credits available, credits wagered, number of lines played (when appropriate), bonuses won, progressive won, game winnings (credits won) and credits cashed out. For "pick" bonuses, the intermediate steps involving the player picks can be retained. In games with free spins, the initiating game is retained with all or, for cases where more than fifty free games have been awarded, at least the last fifty free games played. This gaming information can be displayed in the recall screens through standard text meters, screen shots, graphical display elements and textual representations of specific situations that occurred during game play. The game play history can illustrate unique game play features associated with the game in general and specific game features that occurred during the instantiation of a particular play of the wager-based game.

A gaming machine controller configured to generate a wager-based game in accordance with player selected volatility parameters is described with respect to FIG. 8. Gaming software used to generate the wager-based game is discussed with respect to FIG. 8. With respect to FIG. 9, a power hit tolerant memory configured to store crucial data generated from playing the wager-based game is discussed. The crucial data can include information associated with selected volatility parameters and wager-based games generated using the selected volatility parameters.

Figure 10:
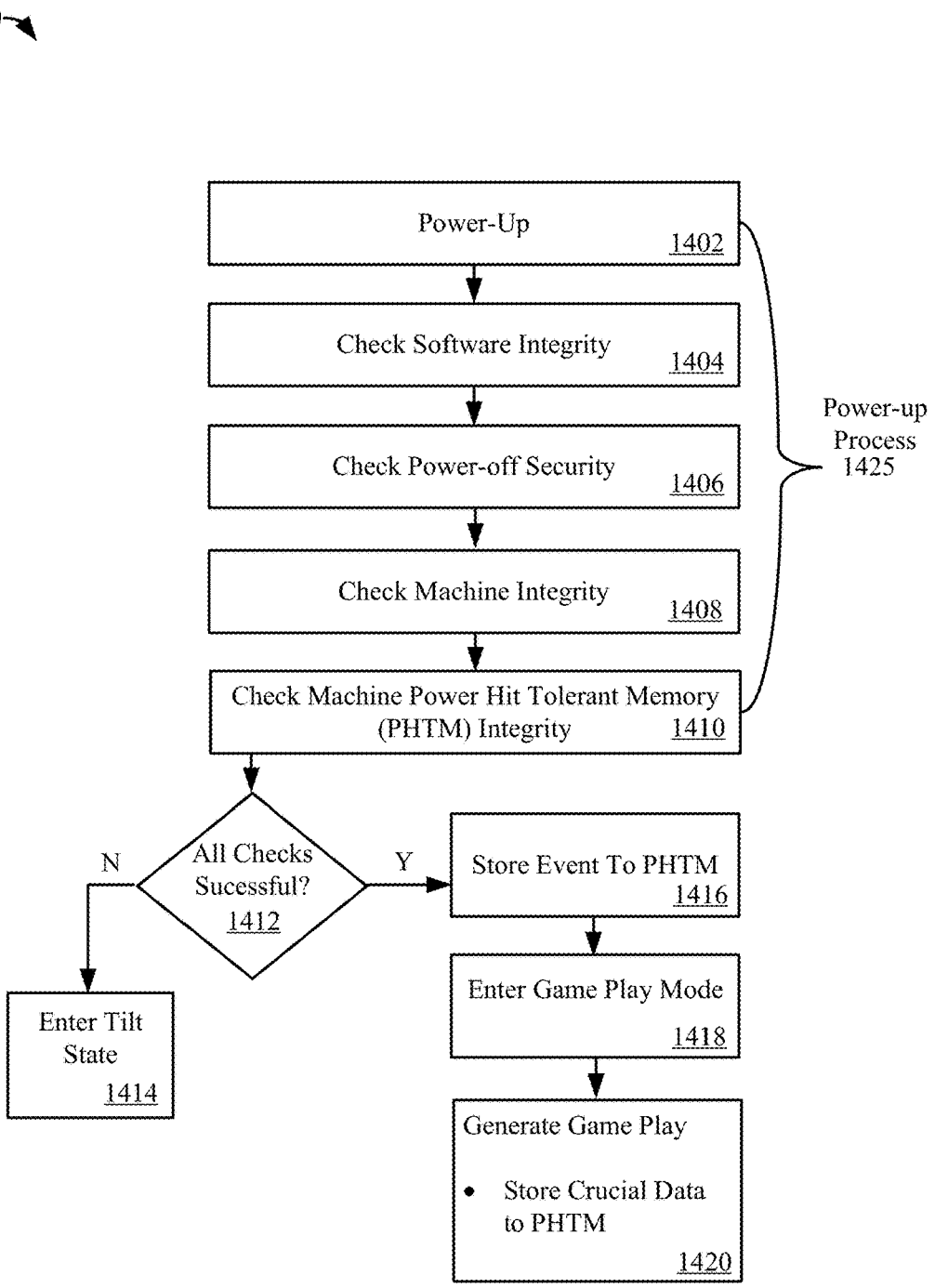
FIG. 10 illustrates a method for responding to a power interruption on a gaming machine in accordance with the present disclosure.

With respect to FIG. 10, a method for responding to a power interruption on a gaming machine, which utilizes the power hit tolerant memory, is discussed. With respect to FIG. 11, a method of powering up a gaming machine is described. Finally, with respect to FIG. 12, a method playing back a game, such as a wager-based game including a first primary game and a second primary game, previously played on a gaming machine is discussed.

FIG. 8 illustrates a block diagram of examples of gaming software 1130 that can be executed by a Gaming Machine Controller (GMC) 1160 in FIG. 7. The game software 1202 can be configured to control the play of the game. The play of the game includes determining a game outcome and award associated with the game outcome using the RNG software 1210.

The game software 1202 can be configured to utilize reel strips and/or wheels of chance with different properties. For example, virtual reel strips with different total number of symbols, different symbol combinations and different stopping probabilities. As described above, the game software may utilize different virtual reel strips in response to a selection of different prize structures involving scatter distributed symbols.

The award can be presented as a number of different presentation components where a portion of the award is associated with each presentation component. These presentation components can be referred to as game features. For example, for a video slot game, game features can involve generating a graphical representation of symbols moving, settling into final positions and lining up along a combination of different lines (e.g., paylines). Portion of the award can be associated with different lines. In another example, the game features can involve free spins and chance award of bonus wilds during the free spins. In yet another example, the game feature can involve generating a graphical representation of symbol and then actuating a mechanical device, such as wheel to indicate an award portion.

In a further example, a game feature can involve a bonus game where a portion of an award for a game is presented in a separate bonus game. The bonus game can involve inputting choices, such as a selection of a symbol. Similar to the primary game, the bonus game can include bonus game features where bonus game award is graphically presented in a number of different portions. A primary game can include game features which trigger different bonus games with different bonus game features.

As described above, game features and bonus game features can be stored to a power hit tolerant memory (PHTM). The PHTM software 1204 can be configured to manage the transfer of crucial data to and from the PHTM. Further, as described above, the PHTM software 1204 can be configured to verify the integrity of the data stored in PHTM.

In particular embodiments, the game 1202 has no knowledge of PHTM. Thus, the utilization of the PHTM can be totally abstracted from the game 1202 and contained in a shared object that is loaded at runtime. This shared object will also determine if the PHTM is available and how much memory space is available. If there is no PHTM, or it doesn't contain enough memory, the shared object can be configured to automatically use a disk file instead. This function may allow the game to be run in a windows environment and still have the ability to recover from a power hit.

One purpose of the PHTM 1204 is proper recovery from a power hit. In order to facilitate proper power hit recovery, numerous transition points can be built into the game 1202 where crucial data is stored to PHTM at each transition. The transitions can be implemented as states, which can be referred to as game states or game state machines. The states themselves can also be stored in PHTM so that on startup, after validating that the PHTM is not corrupt, the game 1202 can then check the current state that is stored. That state will then determine where the game will restart. The idea is that whenever a state transition occurs and is saved, the data needed to recover to that state has also been stored in PHTM.

Different approaches can be used in deciding when to save data to PHTM. In one embodiment, a thread runs in the background that constantly checks the data in memory against a copy of what's in PHTM as well as a force write flag. If the force write flag has been set or if it sees that the crucial data has changed, PHTM software 1204 writes it to the physical PHTM, updating the copy as well.

In another embodiment, the PHTM software 1204 can be configured to write all data directly to PHTM as it occurs. At certain times the PHTM software 1204 can be configured queue writes rather than committing them in order to make it an "all or nothing" write. This feature can be normally done for something that is going to cause a state change, a cash-out, etc. This feature can allow all the meters or crucial data associated with the game to be written at once, keeping the window of opportunity for corruption to the smallest amount of time possible.

In particular embodiments, multiple state machines can be used that are based on the overall game state machine. For example, separate "sub-state machines" can be used for critical functions that use external I/O devices, such as bill acceptors and printers. If the game 1202 restarts in a state that requires more granularity and has a different state machine such as a cash out or a ticket inserted state, it can switch to that sub-state machine to complete the actions and then return to the overall game state machine.

In particular embodiments, the sub-state machine concept can be used for areas of the game that are outside of the main game flow such as bonus games. For example, if the game is in a bonus game with bonus game feature including a free spin bonus round and the power cycles before all of the free spins have finished, the game will recover to the spin that was being executed when the power cycled and will continue from there. If the game is in a bonus game during a bonus game feature including a pick bonus, the game 1202 can recover to the point where the power cycle occurred. In particular, the picks that have already been made can be displayed and then the bonus game can continue from that point including receiving additional picks. Further, the game 1202 may be configured using the crucial data stored in the PHTM to regenerate on the display all or a portion of the game states prior to the power hit, such as the initial state of the game and game states that occurred prior to the bonus game.

The game playback 1206 can be used to display information associated with one or more game states of a wager-based game previously played on a gaming machine. As an example, a particular wager-based game can be initiated and played on the gaming machine. During game play of the particular game, crucial data associated with game states that occur can be stored to the PHTM. Subsequently, one or more additional games can be played on the gaming machine. Then, using crucial data recalled from the PHTM, game information associated with the particular game can be redisplayed on the gaming machine. The game information can include but is not limited to a) text information, b) screen shots that were generated during game play and c) a regeneration of all or a portion of a graphical game presentation associated with the particular game.

Typically, to access the gameplay back feature, the gaming machine has to be placed in a tilt mode where an operator menu is available. From the operator menu, using game playback software 1206, an operator can select a particular game for playback from among a plurality of games previously played on the gaming machine. To resume normal game play, the tilt mode can be cleared and the gaming machine can revert to a normal operating state. More details of game play back are described with respect to FIG. 12.

The security software 1208 can be configured to respond to information received from various security sensors disposed on the gaming machine and from the power-off security device (e.g., see 1138 in FIG. 7). For example, the security software 1208 can be configured to detect that a locking mechanism has been actuated on the gaming machine and then cause the gaming machine to enter a tilt mode. As another example, the security software 1208 can be configured to receive information from the power-off security device that the gaming machine door was opened while the gaming machine was being shipped. In response, the security software 1208 can cause the gaming machine to enter a tilt state. In yet another embodiment, the security software 1208 may not be able to detect a sensor, such as a sensor (e.g., see sensors 1140 in FIG. 7) which monitors a state of a door and in response enter a tilt state.

The RNG software 1210 can be configured to generate random numbers used to determine the outcome to a wager-based game. In one embodiment, a Mersenne twister random number generator (RNG) algorithm, which generates integers in the range [0, 2^k−1] for k-bit word length with a period of (2^9937)−1 can be used. It has a longer period and a higher order of equi-distribution than other pseudo-random number generators. The Mersenne Twister is also very fast computationally as it uses no division or multiplication operations in its generation process. It can work well with cache memory and pipeline processing.

In particular embodiments, the RNG cycles at seventy RNG cycles/second or above, such as equal to or above one hundred RNG cycles/second. This speed has been determined by engineers at the Nevada Gaming Control Board to be fast enough that it cannot be timed by the player. The tests showed that above seventy RNG cycles/second successfully hitting a specific outcome became sporadic, and the results were completely unpredictable at one hundred RNG cycles/second. An evaluation showed the variance in the contact mechanism of mechanical switches and the inherent variance in the "button press" detection circuitry, combined with the inability of a person to repeat a movement, provided enough ambiguity in the final registration of the button press to eliminate a player's ability to affect the payback characteristics of the game.

The RNG can be seeded using a plurality of variables. In particular embodiments, the RNG can be seeded by four variables that eliminate the same seed sequence from being used in more than one device, such as two gaming machines using the same RNG seed. The variables can be 1) absolute time, 2) time since the machine powered up, 3) machine number and 4) a random number from the kernel base RNG "/dev/urandom." The random number from the kernel can be associated with the Linux Kernel. This RNG "/dev/urandom" can be based on random occurrences, such as times between keystrokes, mouse movements, timing between interrupts, and hardware occurrences. These occurrences can be used to build and maintain an entropy pool.

The system protects against the same sequence in several ways. First, even if two games are powered on at exactly the same time, there is enough variability in the exact time that the time since power up should prevent any two games from having the same number returned from this function. Also, the "urandom" RNG is entropy based, and is self-seeded from environmental noise contained in the kernel, which makes it unlikely that two machines would ever have the same seed. Finally, the machine number (EPS number) is used as part of the seed. Because this number is used to uniquely identify the gaming machine on the floor, it should always be different from any other machine.

The communications software 1212 can be used to provide communications via the various communication interfaces and using various communication protocols. For example, the communications software 1212 can support the SAS protocol over wired or wireless communication interfaces. In another example, the communication software may allow the gaming machine to communicate with a mobile device via a wireless communication interface using a Bluetooth™ protocol.

The player tracking software 1214 may allow the GMC to communicate with a player tracking device installed on the gaming machine and/or directly with a remote server which provides player tracking services. For example, a player tracking device can be configured to communicate a GMC to transfer credits to and from the gaming machine. In another embodiment, the GMC can be configured to receive player tracking information from a card inserted in a card reader (e.g., see 1028 in FIG. 1) or via wireless communications with a player's mobile device. Then, GMC can communicate with a remote server to receive information associated with a player and send information associated with the player's game play on the gaming machine.

The devices software 1216 may be used to allow the GMC to communicate with various devices coupled to the gaming machine, such as I/O devices coupled to gaming machine. For example, the devices software may allow the GMC to communicate with a bill acceptor (e.g., see bill acceptor 1024 in FIG. 1) and in response add credits to the gaming machine. In another example, devices software may allow the GMC to communicate with a printer (e.g., see printer 1022 in FIG. 1) and in response cash out credits from the gaming machine in the form of printed ticket.

The power hit software 1218 can allow GMC to respond to power hits. For example, the power hit software can monitor the power supply and in response to a detection of power fluctuations update the PHTM with crucial data. In another example, when the gaming machine is power-up from a power hit, the power hit software 1218 can determine the power hit occurred during game play and initiate a restoration of the gaming machine to its state when the power hit occurred.

The tilt software 1220 can be configured to monitor sensors and gaming devices for tilt conditions. In response to the detection of a tilt condition, the tilt software 1220 can cause the gaming machine to enter a tilt state. Further, the tilt software 1220 can record tilt information to the PHTM.

For example, when a machine door open is detected, the game can tilt with a hard tilt that prevents play and disables the game. If the gaming machine includes a tower light, the tower light can flash to indicate that a door is open. Further, a "DOOR OPEN" indication can be displayed on the main display screen. Upon a detection of the door closing, the tower light can stop flashing and the "DOOR OPEN TILT" can be replaced with a "DOOR CLOSED SOFT TILT."

The door open tilt condition can be the behavior for all the machine doors, such as door 1014 in FIG. 1 or a CPU enclosure door (not shown). Additionally, the behavior may not change for multiple doors that are open. Thus, the "DOOR OPEN" indication can remain on, and the machine will be disabled until all the doors are closed. After the final door is closed, the tower light can go off, the game can become playable and the "DOOR OPEN" indication can be written over by a "DOOR CLOSED" indication which will remain until the end of the next game cycle.

A number of tilts can be generated that must be cleared by an attendant. These tilts may include clearing the condition with a key switch or, for tilts such as "PAPER OUT," the tilt may clear automatically after the attendant has remedied the malfunction. A low battery for a PHTM (e.g., see NVRAM 1122 in FIG. 7 or 1204 in FIG. 8) can be indicated by a "RAM BATTERY" tilt.

A "PRINT FAILURE" tilt can occur when there is a failure to print a ticket. In response, a printer hard tilt error can be issued and the description will indicate that the printer is offline. The tilt can be cleared when the printer is brought back online.

A "PRINT MECHANISM/PAPER JAM" tilt can occur for a paper jam. The game can indicate the paper jam has occurred and the printer is off-line (e.g., see printer 1022 in FIG. 1). This tilt can be cleared by clearing the jam and reinserting the paper into the printer.

A "PAPER OUT" tilt can occur when the printer runs out of tickets (e.g., see printer 1022 in FIG. 1). In response to detecting no remaining tickets, the game can display information indicating no paper is available and the game can be disabled. This tilt can be cleared when new printer stock is fed into the printer.

A defective storage media tilt can occur when an error is detected in a critical memory device, such as the memory storing the game software (e.g., see 1130 in FIG. 7), the memory storing the BIOS (e.g., see BIOS 1126 in FIG. 7) or the PHTM storing crucial data (e.g., see NVRAM 1122 in FIG. 7). A message indicating the validation error can be displayed. This tilt may require a "RAM CLEAR" to remedy the tilt condition. A "RAM CLEAR" can erase all meter, recall and other critical memory.

As described above, multiple copies of crucial data can be stored in the PHTM (e.g., see NVRAM 1122 in FIG. 7) and the GMC (e.g., see GMC 1160 in FIG. 7) can be configured to detect and correct copies of faulty data. When uncorrectable memory is detected in the PHTM or another device, it can result in a "CRITICAL MEMORY ERROR" tilt. Again, this tilt can require a "RAM CLEAR" to remedy the condition. Again, the "RAM CLEAR" can erase all meter, recall and other critical memory.

A "BILL JAM" can occur when the bill acceptor detects a bill jam (e.g., see bill acceptor 1024 in FIG. 1). The tilt condition can be displayed on the display, such as main display 1018 in FIG. 1. This is a hard tilt which disables the game until an operator clears the bill jam condition.

When a stacker is full, the game can displays a soft tilt error on the main screen. A "stacker full" may be displayed as a security measure. The stacker can be coupled to a bill acceptor and located in the main cabinet of a gaming machine (e.g., see bill acceptor 1024 in FIG. 1). The game can remain playable but will not accept any further currency or tickets. This tilt is automatically cleared once the stacker is emptied or replaced. When the stacker is removed, the game will be disabled and display a "STACKER OPEN" message. This tilt can be cleared when the stacker is reinserted.

The software validation software 1222 can be executed by the CPU to validate the various software components on the gaming machine. For example, hashes of memory blocks can be performed and compared to stored hash values. This software can differ from the validation logic which is executed separately by the BIOS to perform validation functions.

The metering software 1224 can be used to update the hard meters and generate and update the soft meters. The metering software 1224 can be configured to store metering information to the PHTM (e.g., see NVRAM 1122 in FIG. 7). Examples of the meters which can be maintained are described above with respect to meters 1144 in FIG. 7.

FIG. 10 illustrates a block diagram of one embodiment of a power hit tolerant memory (PHTM) (Additional details of PHTMs are described with respect to NVRAM 1122 in FIG. 8 and PHTM 1204 in FIG. 8). Crucial information associated with the current game can be stored in 1302. Some examples of crucial information include but are not limited to a wager amount, a game outcome, one or more random numbers to determine the game outcome, information about game states and sub-states including the current game state, an amount won, initial credits and frame captures associated with one or more states. As described above, this information can be used to return the game to a current state after a power-hit. The one or more random numbers can be used to regenerate a particular game outcome associated with the random numbers and the wager amount.

After a game is completed, it can be moved to a game history partition 1304. The game history partition can store crucial data associated with a plurality of previously played games. For example, in one embodiment, the PHTM 1300 can be configured to store crucial data associated with the current game and nine past games. In another embodiment, the PHTM 1300 can store information associated with up to one hundred past games.

When the maximum number of games in the game history partition is reached, the software which manages the PHTM 1300 can be configured to delete the oldest game. This process can occur prior to starting the next game. For example, if a maximum of ten games are stored in the game history 1304, then prior to the play of the eleventh game, the oldest game can be cleared from the memory. In one embodiment, prior to the deletion of the crucial data associated with the oldest game, it can be copied to a secondary persistent memory.

In 1306, accounting information can be stored. The accounting information can include the metering information previously described above. In some embodiments, this information can be recalled in the event of a power failure.

In 1308, machine configuration information can be stored. Some example of machine configuration information can include but is not limited to Manufacturer ID, date of manufacturing, machine ID, operating system version, number of screens, cabinet type, hard disk capacity, PHTM capacity, number of PHTM banks, printer model information, touch screen model information, card reader model information, bill acceptor model information, display model information, jurisdiction information, casino name and other information, sales order #, manufacture information, logo's, etc. In one embodiment, the public key used in the code validation process can be stored here.

In game configuration 1310, game configuration information can be stored. The game configuration information can include paytable selection, game features selections, bonus selections, jackpot contribution setting, denominations, max number of paylines, number of game titles and game versions. A gaming machine can have many paytables with different holding percentages which can be selected by the casino. Similarly, selectable game features and bonus features can be provided.

In security 1312, security information can be stored. Security information can include information that lead to a tilt condition and the associated tilt condition. For example, if a door is opened, the security information can include when the door was opened, when game play was disabled, when the door was closed, when the tilt condition was cleared and when game play was subsequently enabled.

Figure 11:
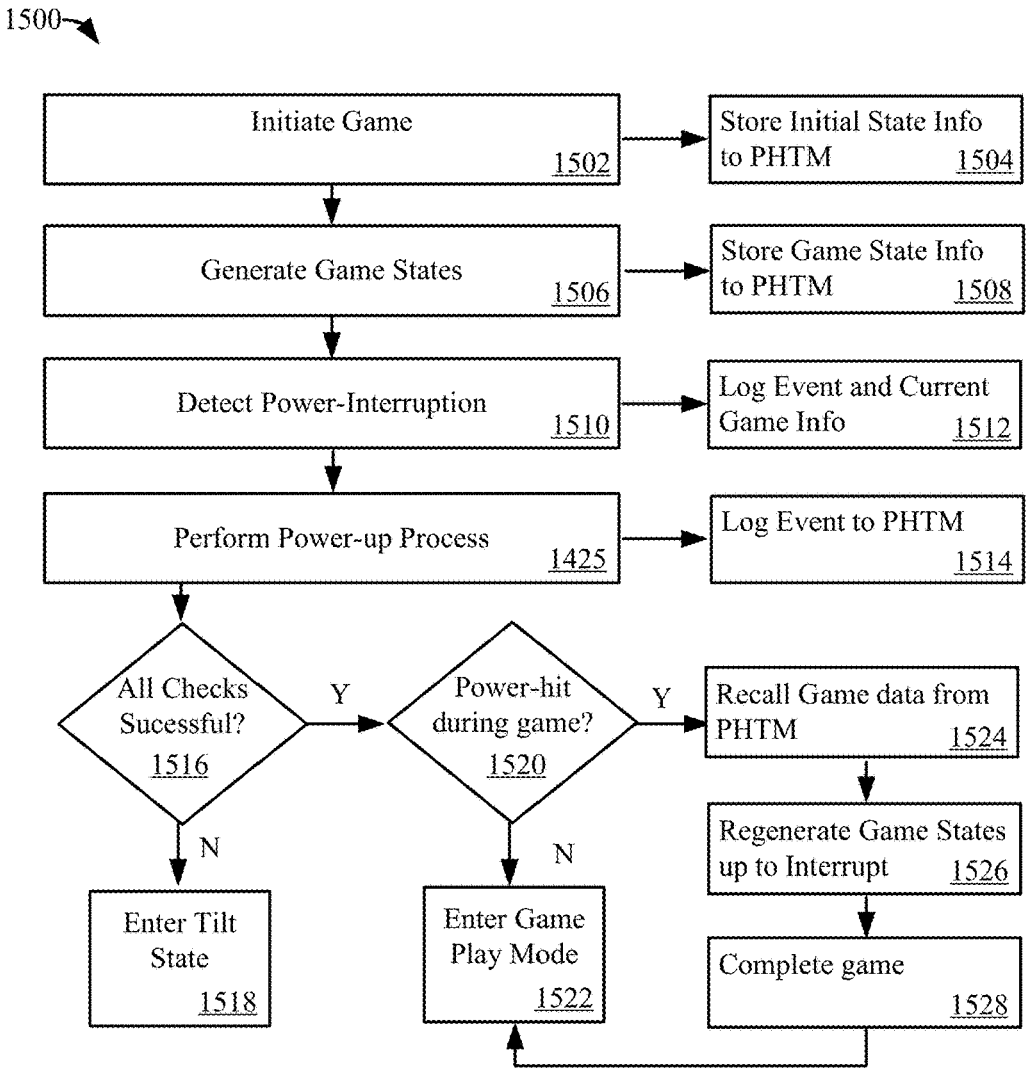
FIG. 11 illustrates a method powering up a gaming machine in accordance with the present disclosure.

FIG. 11 illustrates a machine-implemented automated method 1400 for responding to a power interruption on a gaming machine. In 1402, the gaming machine can begin a power-up process 1425. The power-up process can begin when a power switch in the interior of the gaming machine is turned on or when power is restored after a power interruption. In response to detecting external power is available, a signal can be generated which initiates a software integrity check on in 1404.

In 1404, the software integrity on the gaming machine can be checked. In particular embodiments, a public key/private key method and a "ladder of trust" can be used to verify control programs executed by the game controller. The initial rung of the ladder of trust can be the BIOS EPROM (see 1126 in FIG. 7), which may be a conventional ROM device. This conventional ROM device can load and can verify the initial code which continues the "verify then load" ladder of trust until the entire operating system and the game is loaded. This process was described above in detail with respect to FIG. 7.

In 1406, the power-off security device (see 1138 in FIG. 7) can be checked. The power-off security can monitor all the doors in the EGM. For example, the doors can use optical emitter/sensor pairs, but some might also use Hall-effect sensors. The system can be a standalone device with a CPU, RAM, NVRAM, sensors I/O board, and battery. The battery can be configured to last at least 30 days. It can be configured to record all critical events, such as power brown out, power black-out, main door open, logic (CPU) door open, bill acceptor door open, printer door open, top box door open and player tracking door open. These critical events may have occurred while the GMC was shut down and hence not monitoring the gaming machine for critical events.

In 1408, the machine integrity can be checked. For example, the security sensors on the gaming machine can be checked to verify all the doors are closed. Further, gaming devices, such as the printer and the bill acceptor, can be checked to determine the devices are operating properly (e.g., see printer 1022 and bill acceptor 1024 in FIG. 1).

In 1410, critical memory on the gaming machine can be checked. For example, the PHTM can be checked to make sure the stored information matches associated hash values. As described, a hash value can be generated for crucial data stored in the PHTM. The hash values can be stored with the crucial data. When the PHTM integrity is checked, new hash values can be generated and compared to the stored hash values.

In 1412, the GMC can determine whether all the checks were successful. If one or more of the checks are not successful, in 1414, the gaming machine can enter a tilt state and game play on the gaming machine can be disabled. Information about the tilt state can be output to a display, such as the main display on which a gaming presentation for a wager-based game is output.

In 1416, when all the checks are successful, event information associated with the successful power-up process can be stored to the PHTM. For example, the time that the gaming machine was enabled for game play can be stored to the PHTM. In one embodiment, as described above, this information can be used to generate a seed for a random number generator used on the gaming machine.

In 1418, the gaming machine can enter game play mode. Thus, the gaming machine is enabled to accept bills and tickets that are redeemed for credits on the gaming machine. After credits are deposited, the gaming machine can be used to make wagers on the game(s) available for play on the gaming machine. In 1420, the GMC can generate wager-based game play on the gaming machine and store crucial game play data to the PHTM.

FIG. 11 illustrates a method 1500 powering up a gaming machine. In 1502, a wager can be placed and a game can be initiated. In 1504, initial state information associated with the game can be stored to the PHTM. In 1506, game states associated with the game can be generated. In 1508, crucial data associated with the game states can be stored to the PHTM.

In 1510, a power-interruption can be detected. For example, the GMC can receive a signal from the power supply which indicates a power spike associated with a power shutdown has occurred. In 1512, the event can be logged to the PHTM. In addition, current game state information can be logged to the PHTM prior to the power failure. After power is lost, the GMC may no longer operate unless an uninterruptable power supply is available.

In 1425, the power-up process in FIG. 10 can be performed. In 1514, this event can be logged to the PHTM. In 1516, whether the power-up process is successful can be checked. In 1518, if the check is not successful, the gaming machine can be placed in a tilt state and information about the tilt state can be output.

In 1520, a check can be performed to determine whether the power-hit occurred during the play of a game and prior to completion of the game. This information can be stored in the PHTM. In 1524, when the power-hit occurred during the play of a game, data associated with the game including the current game state can be retrieved from the PHTM. In 1526, the game can be regenerated up to the current game state just prior to the power hit. In some embodiments, the gaming machine can be configured in the current game state without showing any information leading up to the current game state. In other embodiments, one or more game states prior to the current game state can be regenerated and output to the display.

In 1528, the current game can be completed. In 1522, the game can be enabled for game play. In 1520, when the power-hit didn't occur during play of a game, the gaming machine can be powered-up and enabled for game play in 1522.

Figure 12:
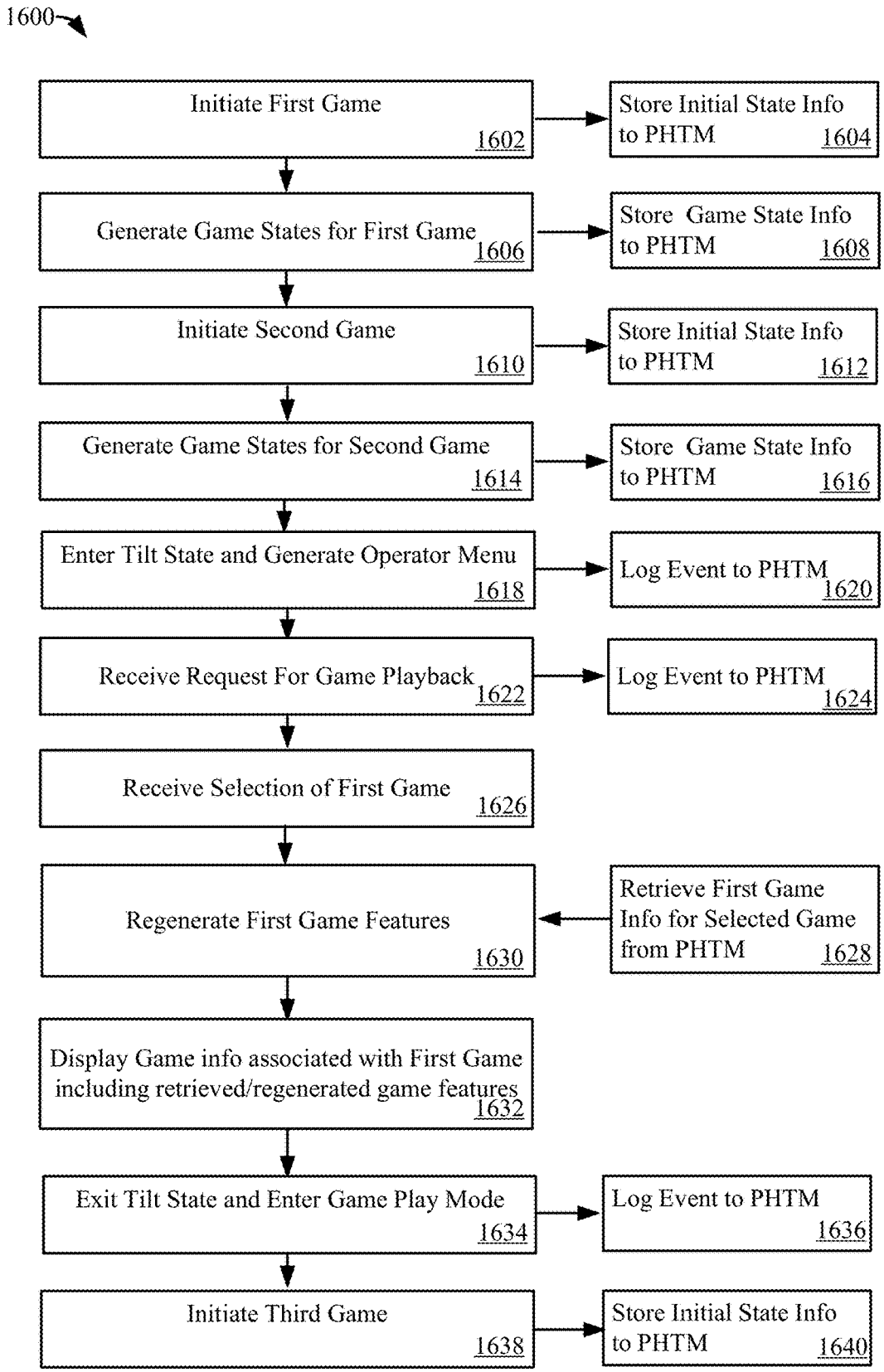
FIG. 12 illustrates a method playing back a game previously played on a gaming machine in accordance with the present disclosure.

FIG. 12 illustrates a method 1600 playing back a game previously played on a gaming machine. In 1602, a first game can be initiated on the gaming machine. In 1604, initial state information about the first game can be stored to the PHTM. In 1606, game states for the first game can be generated. In 1608, the game states can be stored to the PHTM. As described, in the event of a power-hit during play of the first game, the GMC (e.g., see GMC 1160 in FIG. 7) can be configured to restore the game and the gaming machine to a game state just prior to the power hit using information retrieved from the PHTM (e.g., see NVRAM 1122 in FIG. 7).

After the completion of the first game, in 1610, a second game can be initiated. The initial state information for the second game can be stored to the PHTM (e.g., see NVRAM 1122 in FIG. 7). In 1614, the game states for the second game can be generated and the second can be brought to completion. In 1616, the game state information for the second game can be stored to the PHTM.

In 1618, the gaming machine can enter a tilt state. In one embodiment, the tilt state can be initiated in response to the operator inserting and turning a key in a locking mechanism on the outside of the gaming machine cabinet. Then, an operator menu can be generated and output to a display on the gaming machine. In 1620, the tilt state event can be logged in the PHTM.

In the 1622, the gaming machine using an input device, such as a touch screen, can receive a request for a game playback. The game playback can involve displaying information about a game previously played on the gaming machine. In 1624, this event can be logged to the PHTM. In 1626, a particular previously played game can be selected from among a plurality of games with game information stored in the PHTM. In this example, the first game played is selected.

In 1628, game information associated with the first game is retrieved from the PHTM. Some examples of game information which can be retrieved includes but are not limited one or more of random numbers used to generate the first game, screen shots, award information, bet information, credit information and screen shots from one or more game states.

In 1630, first game features can be regenerated. These game features can include animations of the play of the game, which represent one or more game states, or static images representing different game states. The animations of the play of the game can be regenerated using random numbers associated with the original play of the first game.

In 1632, game information associated with the first game, including the retrieved screen shots, regenerated static images and regenerated animations, can be output to a display on the gaming machine. In one embodiment, the display can be the display where the game presentation for the wager-based game is output (e.g., see display 1018 in FIG. 1). In 1634, the gaming machine can exit the tilt state and enter game play mode. For example, to initiate this process an operator can turn a key in the locking mechanism and remove it from the locking mechanism.

In 1636, initiation of game play can be logged as an event to the PHTM. In 1638, a third game on the gaming machine can be initiated. In 1640, the initial state information associated with the third game can be stored to the PHTM.

Because such information and program instructions may be employed to implement the systems/methods described herein, the present disclosure of invention relates to tangible (non-transitory) machine readable media that include program instructions, state information, etc. for performing various operations described herein. Examples of machine-readable media include hard disks, floppy disks, magnetic tape, optical media such as CD-ROM disks and DVDs; magneto-optical media such as optical disks, and hardware devices that are specially configured to store and perform program instructions, such as read-only memory devices (ROM) and programmable read-only memory devices (PROMs). Examples of program instructions include both machine code, such as produced by a compiler, and files containing higher level code that may be executed by the computer using an interpreter.

Although many of the components and processes are described above in the singular for convenience, it will be appreciated by one of skill in the art that multiple components and repeated processes can also be used to practice the techniques of the present disclosure.

While the present disclosure of invention has been particularly shown and described with reference to specific embodiments thereof, it will be understood by those skilled in the art that changes in the form and details of the disclosed embodiments may be made without departing from the spirit or scope of the present teachings. It is therefore intended that the disclosure be interpreted to include all variations and equivalents that fall within the true spirit and scope of the present teachings.

What is claimed is:

1. A gaming machine comprising:

a cabinet including an entry that provides access to an interior of the cabinet, a locking mechanism coupled to the entry and a plurality of security sensors wherein at least one of the plurality of security sensors is used to detect access to the interior of the cabinet;

a power supply, disposed within the interior of the cabinet, receiving power from an external power source;

a power-off security device disposed within the interior of the cabinet, coupled to at least one of the plurality security sensors and monitoring access to the cabinet when the power supply is unpowered;

a display, coupled to the cabinet, outputting content associated with play of one or more wager-based games;

an input source receiving one or more selections from a player;

a non-volatile memory, disposed within a locked box within the interior of the cabinet, storing non-transitory gaming software used to generate one or more wager-based games on the gaming machine wherein the gaming software defines a plurality of selectable prize structures and a plurality of sets of virtual reel strips wherein predetermined permutations of chance spins of the sets of the virtual reel strips are respectively associated with one of the plurality of selectable prize structures;

a power-hit tolerant memory, disposed within the locked box within the interior of the cabinet and storing crucial data associated with a play of a plurality instances of a corresponding one of the plurality of wager-based games;

a gaming machine controller, including a processor and a memory, disposed within the locked box within the interior of the cabinet, coupled to the power supply, the power-off security device, the plurality of security sensors, the display, the non-volatile memory and the power-hit tolerant memory, the gaming machine controller 1) controlling play of sequential instances of an active one of the plurality of wager-based games, 2) validating the gaming software, 3) verifying integrity of crucial data stored within the power hit tolerant memory, 4) monitoring the power-off security device and the plurality of security sensors to detect tilt conditions; 5) outputting to the display one or more of the plurality of selectable prize structures, 6) during play of a particular instance of the active wager-based game, receiving a first indication of a selection from the input source of a first prize structure from among the plurality of selectable prize structures, 7) generating an outcome to the particular instance of the active wager-based game; 8) storing crucial data associated with the play of the plurality of sequential instances of the active wager-based game to the power-hit tolerant memory; 9) determining near-completion of wagered upon gaming action and in response determining if one or more end-of-spin bonus opportunities should be offered to supplement the near-completion wagered upon gaming action, 10) displaying an end-of-spin bonus awarding chance mechanism in response to the determined near-completion and in response to a determination that the one or more end-of-spin bonus opportunities should be offered; 11) actuating the displayed end-of-spin bonus awarding chance mechanism which includes an opportunity for a multi-symbol transformation along a picked multi-symbol transforming (MST) target line and determining which MST tool is to be applied, if at all to a respective MST target line; 12) applying the determined MST tool to the respective MST target line; and 13) determining what end-of-spin bonus gains, if any are being supplementally awarded to the player beyond those gains called for by the nearly completed end-of-spin of the wagered upon gaming action taken alone.

2. A machine-implemented method comprising:

causing, in response to receiving indication of a player submitted wager, an actuation of a first gaming action corresponding to the submitted wager, the first gaming action completing with a display of a combination of initial symbols in a gaming action outcome area;

prior to full completion of the actuated first gaming action, causing a first determination as to whether an additional bonus opportunity will be presented to the player for possibly obtaining additional gains beyond first gains, if any, obtained based on full completion of the first gaming action taken alone;

in response to said first determination determining that the additional bonus opportunity should be presented, causing presentation to the player of at least one multi-symbol transforming (MST) tool that can be applied to multiple ones of initial symbols as found along a respective at least one MST target line;

following said presentation of the at least one MST tool, causing application of the at least one MST tool to the multiple ones of initial symbols found along the respective at least one MST target line;

responsive to the application of the at least one MST tool, causing respective transformations of at least two of the multiple initial symbols found along the respective at least one MST target line, where the caused transformations can result in at least one of: upgrading of the respectively transformed initial symbol, production of a prize from the respectively transformed initial symbol, production from the respectively transformed initial symbol of a virtual projectile that can enhancingly further transform others of initial symbols not found along the respective at least one MST target line, and presentation of entertaining visual and/or audio effects; and responsive to the transformations of at least two of the multiple initial symbols found along the respective at least one MST target line and responsive to the enhancing further transformation caused by the virtual projectile, if produced, tallying up the additional gains to be awarded to the player as a result of the application of the at least one MST tool.

3. The method of claim 2 and further comprising:

after application of the at least one MST tool, causing presentation to the player of at least a second multi-symbol transforming (MST) tool that can be obtained for application to multiple ones of second initial symbols of a second actuated gaming action corresponding to a submitted second wager if the player submits the second wager.

4. The method of claim 2 wherein:

the first gaming action includes an apparent first spinning of chance reels or wheels whose chance settlement outcome can provide a winning combination of initial symbols along an active pay line of the first gaming action; and the first determination determining whether the additional bonus opportunity should be presented includes presentation of an apparent second spinning of chance reels or wheels whose chance settlement outcome determines at least one of: (a) which MST tool will be applied and (b) which MST target line the applied MST tool will be applied along.

5. The method of claim 2 wherein:

prior to full completion of the first gaming action, a selection mechanism is presented to the player for allowing the player to pick one of a plurality of different MST tools.

6. The method of claim 2 wherein:

prior to full completion of the first gaming action, a selection mechanism is presented to the player for allowing the player to pick one of a plurality of different MST target lines.

7. The method of claim 2 wherein:

the at least one multi-symbol transforming (MST) tool includes a virtual cutting tool for attempting to cut open the initial completion symbols of the first gaming action, where if the attempted cutting open is successful, it release at least one of prizes, projectiles and/or pleasing effects hidden within the initial completion symbols before they are cut open.

8. The method of claim 7 and further wherein:

prior to said attempt at cutting open, each of the initial completion symbols of the first gaming action is assigned a respective transformation response nature which can include immunity to, resistance to or extra susceptibility to being cut open by a respective virtual cutting tool.

9. The method of claim 2 and further wherein:

prior to said application of the MST tool, each of the initial completion symbols of the first gaming action is assigned a respective transformation response nature which can include immunity to, resistance to or extra susceptibility to being transformed by a respective MST tool.

10. The method of claim 2 wherein:

the at least one multi-symbol transforming (MST) tool includes a virtual spraying tool for spraying a corresponding virtual fluid onto the initial completion symbols found along the MST target line, the sprayed on virtual fluid having at least one of an additive effect and subtractive effect on the sprayed upon initial completion symbols that are not immune to the corresponding virtual fluid.

11. The method of claim 10 wherein:

the spraying of the corresponding virtual fluid can cause projecting of transformative juices onto others of the initial completion symbols that are not found along the MST target line.

12. The method of claim 2 wherein:

the at least one multi-symbol transforming (MST) tool includes a wilding tool that transforms at least two of the initial completion symbols found along the MST target line into Wilds.

* * * * *